US006086717A

United States Patent [19]

Snekkenes et al.

[11] Patent Number: 6,086,717

[45] Date of Patent: Jul. 11, 2000

[54] SEPARATOR HAVING A SCREEN BASKET DISPOSED IN A DIGESTER

[75] Inventors: Vidar Snekkenes, Karlstad; Sven-Erik Olsson, Kil, both of Sweden

[73] Assignee: Kvaerner Pulping AB, Sweden

[21] Appl. No.: 09/007,510

[22] Filed: Jan. 15, 1998

Related U.S. Application Data

[63] Continuation-in-part of application No. 08/908,285, Aug. 7, 1997.

[51] Int. Cl.[7] ..... D21C 7/06; D21C 7/08

[52] U.S. Cl. ..... 162/245; 162/246

[58] Field of Search ..... 162/52, 236, 245, 162/246; 210/413

[56] References Cited

U.S. PATENT DOCUMENTS 3,902,962 9/1975 Reinhall ..... 162/246

5,089,086 2/1992 Silander ..... 162/19

5,882,477 3/1999 Laakso et al. ..... 162/63

FOREIGN PATENT DOCUMENTS 9001467 4/1990 Sweden .

*Primary Examiner*—Dean T. Nguyen

*Attorney, Agent, or Firm*—Fasth Law Offices; Rolf Fasth

[57] ABSTRACT

A new and improved way of continuously cooking fiber material, wherein temperatures and alkaline levels are controlled to be maintained within specific levels in different zones of the digesting process in order to optimize chemical consumption and heat-economy and at the same time achieve very good pulp properties. The digesting process includes a top separator that separates the transport liquid from the fiber material and permits the fiber material to be exposed to the cooking liquid.

42 Claims, 18 Drawing Sheets

FIG. 13

LABORATORY COOKING

GENERAL CONDITIONS

| | |
|---|---|
| Wood specie: | Scandinavian softwood, chips |
| Steaming, minutes | 5 |
| Temperature, °C | 110 |
| Pressure, bar | 1.0 |
| Sulfidity, % | 36.4 |

SPECIFIC CONDITIONS

| | Reference | Present Invention |
|---|---|---|
| Cook no. | ITC 1770 | ITC 1763 |
| IMPREGNATION | | |
| Time, minutes | 45 | 45 |
| Temperature, °C | 125 | 125 |
| Alkali consumption, kg EA/BDMT wood | 99 | 92 |
| CONCURRENT COOKING | | |
| Time, minutes | 120 | 120 |
| Temperature, °C | 160 | 145 |
| Alkali consumption, kg EA/BDMT wood | 63 | 66 |
| COUNTERCURRENT COOKING | | |
| Time, minutes | 150 | 150 |
| Temperature, °C | 160 | 155 |
| Alkali consumption, kg EA/BDMT wood | 15 | 10 |
| RESULTS | | |
| H-Factor | 1850 | 874 |
| Alkali consumption, kg EA/BDMT wood | 177 | 168 |

Compact cooked pulp: $O^2$ Kappa 11.1 and visc. 1018 $dm^3/kg$
Reference cooked pulp: $O^2$ Kappa 11.2 and visc. 1014 $dm^3/kg$

SEPARATOR HAVING A SCREEN BASKET DISPOSED IN A DIGESTER

PRIOR APPLICATION

This is a continuation-in-part application of U.S. patent application Ser. No. 08/908,285, filed Aug. 7, 1997.

TECHNICAL FIELD

The present invention relates to a novel top separator and a method for producing pulp, preferably sulphate cellulose, with the aid of a continuous steam/liquid phase digester systems.

BACKGROUND AND SUMMARY OF THE INVENTION

Environmental demands has forced our industry to develop improved cooking and bleaching methods. One recent breakthrough within the field of cooking is ITC™, which was developed in 1992–1993. ITC™ is described in WO-9411566, which shows that very good results concerning the pulp quality may be achieved. ITC™ is mainly based on using almost the same temperature (relatively low compared to prior art) in all cooking zones in combination with moderate alkaline levels. The ITC™-concept does not merely relate to the equalization of temperatures between different cooking zones, but a considerable contribution of the ITC™-concept relates to enabling an equalized alkaline profile also in the lower part of the counter-current cooking zone.

Moreover, it is known that impregnation with the aid of black liquor can improve the strength properties of the fibers in the pulp produced. The aim of the impregnation is, in the first place, to thoroughly soak each chip so that it becomes susceptible, by penetration and diffusion, to the active cooking chemicals which, in the context of sulphate cellulose, principally consist of sodium hydroxide and sodium sulphide.

If, as is customary according to prior art, a large proportion of the white liquor is supplied in connection with the impregnation, there will exist no distinct border between impregnation and cooking. This leads to difficulties in optimizing the conditions in the transfer zone between impregnation and cooking.

Now it has been found that surprisingly good results can be achieved when:

1. Keeping a low temperature but a high alkali content in the beginning of a concurrent cooking zone of the digester;
2. Withdrawing a substantial part of a highly alkaline spent liquor that has passed through at least the concurrent cooking zone; and
3. Supplying a substantial portion of the withdrawn spent liquor that has a relatively high amount of rest-alkali, to a point that is adjacent the beginning of an impregnation zone.

This leads to a reduced H-factor demand, reduced consumption of cooking chemicals and better heat-economy. Additionally, the novel method leads to production of pulp that has a high quality and a very good bleachability, which means that bleach chemicals and methods can be chosen with a wider variety than before for reaching desired quality targets (brightness, yield, tear-strength, viscosity, etc.) of the finally bleached pulp.

Furthermore, we have found that these good results can also be achieved when moving in a direction opposite the general understanding of the IT teaching, in connection with digesters having a counter-current cooking zone. Instead of trying to maintain almost the same temperature levels in the different cooking zones, we have found that when using a digester that has both a concurrent and a counter-current cooking zone, big advantages may be gained if the following basic steps are used:

1. Keeping a low temperature but a high alkali content in the concurrent zone of the digester;
2. Keeping a higher temperature but a lower alkali content in the counter-current zone;
3. Withdrawing a substantial part of the highly alkaline spent liquor that has passed through at least one digesting zone; and
4. Preferably supplying almost all of the withdrawn spent liquor, that has a relatively high amount rest-alkali, to a position that is adjacent the beginning of the impregnation zone.

Also, in connection with digesters of the one-vessel type (without a separate impregnation vessel), surprisingly good results are achieved when the basic principles of the invention are used.

Moreover, preliminary results indicate that the preferred manner of using the invention may be somewhat modified also in other respects but still achieving very good result, e.g., by excluding the counter-current cooking zone. Additionally, expensive equipment might be eliminated, e.g., strainers in the impregnation vessel, hanging central pipes, etc., making installations much easier and considerably less expensive.

BRIEF DESCRIPTION OF THE FIGURES

FIG. 13 shows which conditions were used in the laboratory for one of the ITC-references and one of the cooking methods according to the invention (so called modified ITC);

DETAILED DESCRIPTION

Figure 1:
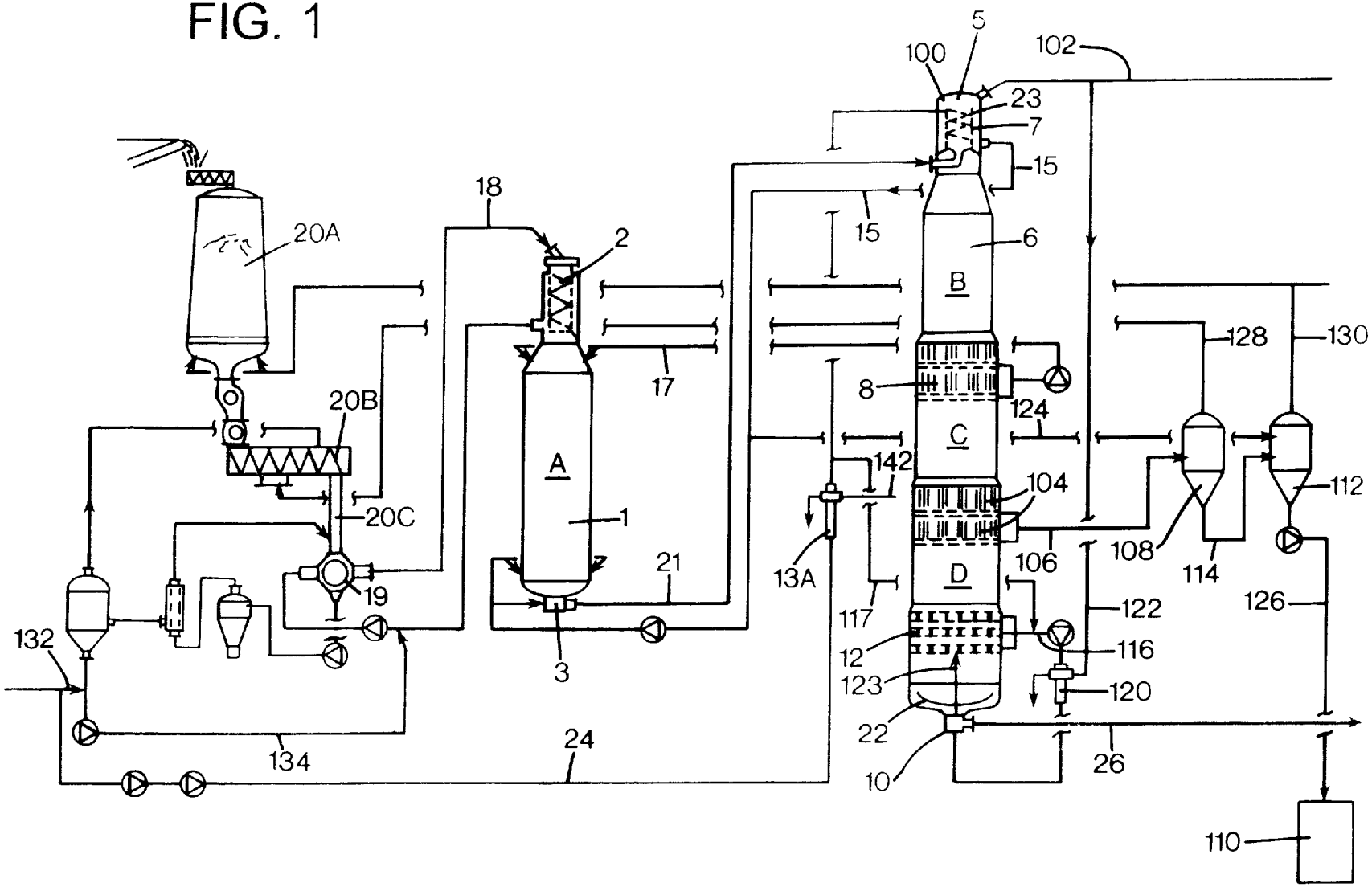
FIG. 1 is a schematic flow diagram of a preferred first embodiment of a digester system according to the present invention.

The preferred embodiments of the present invention are described with reference to FIGS. 1–19. FIG. 1 shows a preferred first embodiment of a two vessel steam/liquid-phase digester for producing chemical pulp according to the present invention, especially in relation to a retrofit of an MCC digester. The main components of the digesting system consist of an impregnation vessel 1 and a steam/liquid-phase digester 6.

The impregnation vessel 1, which normally is totally liquid filled, includes a feeding-in device 2 at the top. The feeding-in device may be of a conventional type, i.e., a top separator having a screw-feeding device that feeds the chips in a downward direction at the same time as a transport liquid is drawn off. Other types of top separators may also be used. At the bottom, the impregnation vessel 1 has a feeding-out device 3 comprising a bottom scraper. In addition to this, there is a conduit 17 that extends from the digester 6 to the impregnation vessel 1 for adding hot black liquor. As seen in FIG. 1, the black liquor is preferably supplied to the top of the impregnation vessel 1. In contrast to conventional impregnation vessels, no draw-off screen is located inside the impregnation vessel. However, such draw-off screen may be provided if desired.

The chips are fed from the chip bin 20A, through the steaming vessel 20B and the chip chute. 20C. A feeding device, preferably a high-pressure feeder 19, feeds the chips suspended in a transport liquid via a conduit 18 to the top of the impregnation vessel 1. The feeder 19 is cooperating with the chute 20C, and is connected to the necessary liquid circulations and replenishment.

A conduit 21, for transporting chips and a transport liquid D, extends from the bottom of the impregnation vessel 1 up to the top 5 of the digester 6. The top 5 has a steam space 100 defined therein. A steam supply line 102 is attached to the top 5 of the digester 6 for supplying steam to the top 5 to heat the steam space 100. The conduit 21 preferably opens up at the bottom of a top separator 7 which feeds the chips by means of a screw in an upwardly moving direction. The screen of the separator may be used to draw off the transport liquid D (which is then returned in line 15) together with which the chips are transported from the impregnation vessel 1 up to the top 5 of the digester. At the upper edge of a separator screen (over which edge the chips tumble out), there is arranged a first integrated annular ring 23 (best seen in FIG. 2). A second supply means such as a second annular ring 25 may be disposed below the first annular ring 23. The annular ring 23 is connected to a conduit 24 which (preferably via a heat-exchanger 13A) leads to a cooking liquor supply such as a white-liquor container (not shown). Similarly, the second annular ring 25 is connected to a conduit 27. The heat-exchanger 13A heats up the white liquor to a suitable temperature before the white liquor enters the top 5. As best seen in FIG. 1, approximately 95% of the total supply of the white liquor in the conduit 24 is supplied to the top 5 of the digester and the remaining 5% is supplied to the high pressure feeder 19 via a conduit 132 and a conduit 134 to lubricate the high pressure feeder 19.

A first screen girdle section 8 may be arranged in conjunction with a step-out approximately in the middle of the digester 6. If the digester 6 is an MCC digester, this screen section is used to withdraw spent liquor that is conducted to a recovery unit. According to the present invention, draw-off from this screen girdle section 8 is conducted directly via the conduit 17 to the impregnation vessel 1. A second screen girdle section 104 may be arranged below the first screen girdle section 8 (in an MCC digester, the screen girdle section 104 would normally be called the MCC screen). Draw-off from the second screen section 104, such as spent liquor, i.e., black liquor, may be conducted via a conduit 106 to a first flash tank 108 to recover steam and let pressure off before the liquor is conducted to a recovery unit 110. Preferably, the spent liquor is also conducted through a second flash tank 112 via a conduit 114 to further reduce the pressure and temperature of the spent liquor before the liquor is conducted to the recovery unit 110. In the preferred embodiment, a conduit 124 conducts the spent liquor from the return conduit 15 (preferably at least 4 $m^3$/ADT; more preferably at least about 5 $m^3$/ADT) to the second flash tank 112. The spent liquor from both flash tanks 108, 112 is then conducted with a conduit 126 to the recovery unit 110. Conduits 128 and 130 may be connected to the flash tanks 108, 112, respectively, to supply steam to the chip bin 20A and the steaming vessel 20B via the conduits 128, 130.

At the bottom 10 of the digester, there is a feeding-out device including one scraping element 22. A third lower screen girdle section 12 is disposed at the bottom 10 of the digester 6. The girdle section 12 may, for example, include three rows of screens for withdrawing liquid, which is heated and to which some white liquor, preferably about 10% of the total amount of the white liquor in conduit 24, is added via a branch conduit 117 before it is recirculated by means of a central pipe 123, which opens up at about the same level as the lowermost strainer girdle 12.

The draw-off from screen girdles 12 and the white liquor from the branch conduit 117 are preferably conducted via a heat exchanger 120 back to the bottom 10 of the digester 6. The temperature of this draw off is somewhat lower than in the cooking zone D (e.g., about 140° C.), since the liquid is a mix of wash liquid and black liquor. The white liquor is supplied in a counter-current direction via the central pipe 123 to the screen girdle section 12. The white liquor provides fresh alkali and, in the form of counter-current cooking, further reducing the Kappa number. A conduit 122 is connected to the high pressure steam conduit 102 to provide the heat exchanger with steam to regulate the temperature of the liquid supplied via the central pipe 123. A blow line 26 is connected to the bottom 10 of the digester for conducting the digested pulp away from the digester 6.

A preferred installation according to the present invention, as shown in FIG. 1, may function as follows. The chips are fed in a conventional manner into the chip bin 20A and are subsequently steamed in the vessel 20B and, thereafter, conveyed into the chute 20C. The high-pressure feeder 19, which is supplied with a minor amount of white liquor (approximately 5% of the total amount to lubricate the feeder), feeds the chips into the conduit 18 together with the transport liquid. The slurry of chips and transport liquid are fed to the top of the impregnation vessel 1 and may have a temperature of about 110° C. to 120° C. when entering the impregnation vessel (excluding recirculated transport liquor).

In addition to the actual fibers in the wood, the fibers also convey their own moisture (the wood moisture), which normally constitutes about 50% of the original weight, to the impregnation vessel 1. Over and above this, some condense is present from the steaming, i.e., at least a part of the steam (principally low-pressure steam) which was supplied to the steaming vessel 20B is cooled down to such a low level that it condenses and is then recovered as liquid together with the wood and the transport liquid.

Inside the top of the impregnation vessel 1, there is a screw feeder 2 disposed which pushes chips in a downward direction. No liquid is necessarily recirculated within the impregnation vessel 1. Instead, spent liquor, such as black liquor, from the screen girdle section 8 is preferably supplied to the impregnation vessel 1. However, it is to be understood that liquid may be recirculated within the impregnation vessel 1, if so desired.

The chips which are fed out from the bottom of the top screen 2 of the impregnation vessel 1 then move slowly downwards in a plug flow through the impregnation vessel 1 in a liquid/wood ratio between 2/1–10/1 preferably between 3/1–8/1, more preferred of about 4/1–6/1. Hot black liquor, which is drawn off from the screen girdle section 8, may be added, via the conduit 17, to the top of the impregnation vessel 1. The black liquor may also be added to other sections of the impregnation vessel such as to an intermediate section of the impregnation vessel. The high temperature of the black liquor (100° C. to 160° C.), preferably exceeding 130° C., more preferred between 130° C. to 160° C., ensures rapid heating of the chips flowing through the impregnation vessel 1. In addition, the relatively high pH, exceeding pH 10, of the black liquor neutralizes acidic groups in the wood and also any acidic condensate accompanying the chips, thereby, i.e., counteracting the formation of encrustation, so-called scaling.

An additional advantage of the method of the present invention is that the black liquor supplied into the impregnation vessel 1 has a high content of rest alkali, (effective alkali EA as NaOH), at least 13 g/l, preferably about or above 16 g/l and more preferred between 13–30 g/l at the top of the impregnation vessel 1. This alkali mainly comes from the black liquor due to the high amount of alkali in the concurrent zone B of the digester 6. Furthermore, the strength properties of the fibers are positively affected by the impregnation because of the high amount of sulphide. A major portion of the black liquor may be directly (or via one flash) fed into the impregnation vessel 1. A minor amount of the black liquor may be used for transferring the chips from the high pressure feeder 19 to the inlet of the impregnation vessel 1.

The minor flow of the black liquor should be cooled (not shown) before it is entered into the feeder 19. The two flows of black liquor are preferably used to regulate the temperature within an impregnation zone A disposed inside the impregnation vessel 1. In the preferred embodiment, the temperature should not exceed 140° C. However, it should be understood that the temperature may exceed 140° C. The total supply of black liquor to the impregnation vessel 1 may exceed 80% of the total amount drawn off from the draw-off strainers 8, preferably more than 90% and most preferred about 100% of the total flow, which normally is about 8–12 $m^3$/ADT.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation vessel 1 may be larger than 1/11, preferably larger than 1/10 of the volume of the digester 6. Additionally, in the preferred embodiment, the volume V of the impregnation vessel 1 should exceed 5 times the value of the square of the maximum digester diameter, i.e., $V=5D^2$, where D is the maximum diameter of the digester 6.

From tests made in lab-scale, we have found indications that it is desirable to keep the alkaline level at above at least 2 g/l, preferably above 4 g/l, in the impregnation vessel 1 in connection with black liquor, which would normally correspond to a pH of about 11. If not, it appears that dissolved lignin precipitate and even condense.

The chips, which have been thoroughly impregnated and partially delignified in the impregnation vessel 1, may be fed to the top of the digester 6 and conveyed into the upwardly-feeding top separator 7. The chips are thus fed upwardly through the screen, meanwhile free transport liquid may be withdrawn outwardly through the separator screen and finally the chips fall out over the edge of the screen down through the steam space 100. Before or during their free fall, the chips pieces are drained with cooking liquor, such as white liquor, which is supplied by means of the annular ring 23 at the top separator 7. The white liquor is preferably heated by the heat exchanger 13A which preferably is supplied with heat steam via a conduit 142.

The quantity of white liquor that is added at the top separator 7 depends on how much white liquor possibly is added else where, but the total amount corresponds to the quantity of white liquor that is required to achieve the desired delignification of the wood chips. Preferably, a major part of the white liquor is added here, i.e., more than 60%, which also improves the diffusion velocity, since it increases in relation to the concentration difference (chip-surrounding liquid). The thoroughly impregnated chips very rapidly assimilate the active cooking chemicals by diffusion, since the concentration of alkali (EA as NaOH) is relatively high, at least 20 g/l, preferably between 30 g/l and 50 g/l and more preferred about 40 g/l.

The chips then move down in the concurrent zones B, C through the digester 6 at a relatively low cooking temperature, i.e., between 130° C. to 160° C., preferably about 140° C. to 150° C. The major part of the delignification takes place in the first and second concurrent cooking zones B, C.

The liquid-wood ratio should be at least 2/1 and should be below 7/1, preferably in the range of 3/1–5.5/1, more preferred between 3.5/1 and 5/1. (The liquid wood-ratio in the counter-current cooking zone should be about the same as in the concurrent cooking zones. A further modification would be to have the cooking zone C to be a counter-current zone or a mixture of con/counter-current.)

Below the draw-off screen section 104 is the counter-current zone D that is defined between the screen girdle section 104 and the screen girdle section 12. The temperature in the counter-current zone D is preferably higher than in the concurrent zones B, C, i.e., preferably exceeding 140° C., preferably about 145° C. to 165° C., in order to dissolve remaining lignin. The alkali content in the lowermost part of the concurrent cooking zone C should preferably be lower than in the beginning of the concurrent zone B, above 5 g/l, but below 40 g/l. Preferably less than 30 g/l and more preferred between 10–20 g/l. In the preferred case, the aim is to have a temperature difference of about 10° C. between the first and the second concurrent cooking zones. Expediently, the conduit 116 may be charged with about 5–20%, preferably 10–15%, white liquor from the conduit 24 via the conduit 117.

The temperature of the liquid which is recirculated via the central pipe 123 up to the screen girdle section 12 is regulated with the aid of the heat exchanger 120 so that the desired cooking temperature is obtained at the lowermost part of the counter-current cooking zone D.

At the lowermost part of the digester, cool wash liquid is added in order to displace, in counter-current, hot liquid which is subsequently withdrawn at the lowermost screen girdle 12.

Figure 2:
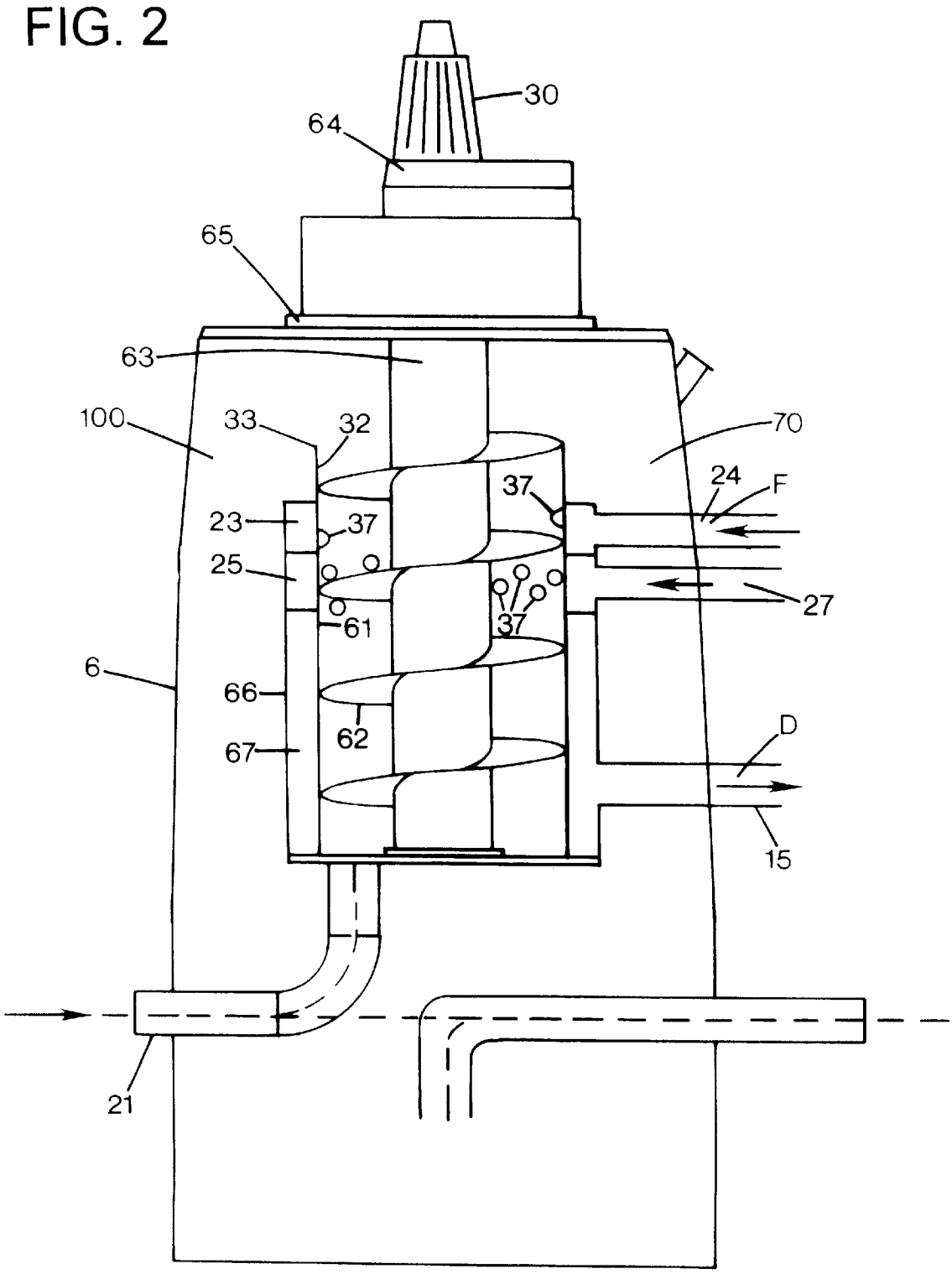
FIG. 2 is a cross-sectional view of a preferred embodiment of a top separator to be used in a steam/liquid-phase digester according to the present invention.

In FIG. 2 there is shown a preferred embodiment of a separator to be used in connection with one of the embodiments of steam/liquid phase digester systems disclosed herein. It is often preferred to have an upwardly feeding top separator for a steam/liquid phase digester. The separator may comprise a screen basket 61 in which a rotatable screw feeder 62 is positioned. The screw feeder is fixedly attached to a shaft 63 which at its upper end is operatively attached to a drive unit 64. The drive unit 64 is attached to a plate 65 which is attached to the digester shell 6.

Circumjacent the screen basket 61 there is arranged a liquid collecting space 67, which may be connected to the return pipe circulation 15. Above the liquid collecting space 67, also circumjacent the screen basket 61, there are arranged a first liquid supply space or opening 23 which is connected to the supply line 24 that supplies white liquor (F) and a second liquid supply space 25 that is connected to a conduit 27 that also may conduct white liquor into the screen. The separator may also have a plurality of inlet apertures 37 defined therein to subject the fiber chips with white liquor. The inlet apertures preferably has a total area that exceeds 400 $mm^2$. More preferred, the total area of the inlet apertures is at least 500 $mm^2$. Most preferred, the total area of the inlet apertures exceeds 600 $mm^2$ to achieve a sufficient flow into the chip pile. The size of the apertures is also important to achieve optimum flow speed to ensure that the white liquor penetrate into the fiber chips. The apertures are preferably symmetrically distributed and circular in shape to evenly distribute the white liquor to provide for iso-chemical conditions. Between the outer peripheral wall 66 of the liquid collecting space 67 and the liquid supply spaces 23, 25, and the digester shell 6 at the top, there exist an annular space 70 which opens up down into the upper part of the digester 6. The functioning of the top separator may be described as follows.

The thoroughly heated and impregnated chips are transferred by means of the supply line 21 into the bottom portion of the screen basket 61. Here the screw feeder 62 moves the chips upwardly at the same time as the transport liquid D is separated from the chips, by being withdrawn outwardly through the screen basket 61 and further out of the digester through return line 15. More and more liquid will be withdrawn from the chips during their transport within the screen basket 61. Eventually, the chips will reach the level of the supply spaces 23 and 25. Here the desired amount of cooking liquor, preferably white liquor, is added through the supply spaces 23 and 25 and the openings 37, having a temperature and effective alkaline content in accordance with the invention.

In order to eliminate the risk of back flowing of the supplied liquid from the supply spaces 23 and 25 into the liquid collection space 67, a minor amount of free liquid (at least about 0.5 $m^3$/ADT) should be left together with the chips, which free liquid will then be mixed with the supplied cooking liquor. Preferably, about one m3/ADT should be left together with the fiber material. Additionally, the white liquor should be provided at a point that is downstream of the flow of the suspension of the fiber material and the free liquid that is being fed through the screw member.

At the top of the screen basket 61, the chips and the cooking liquor may flow over the upper edge thereof and fall into the steam liquid space 70 and further on to the top of the chips pile within the digester, where the concurrent cooking zone (B) starts.

A major advantage of the separation device is that they provide for establishing a distinguished change of zones (it enables almost a total exchange of free liquid at this point), which means that for a two vessel system the desired conditions in the beginning of the concurrent zone (B) can easily be established.

Figure 3:
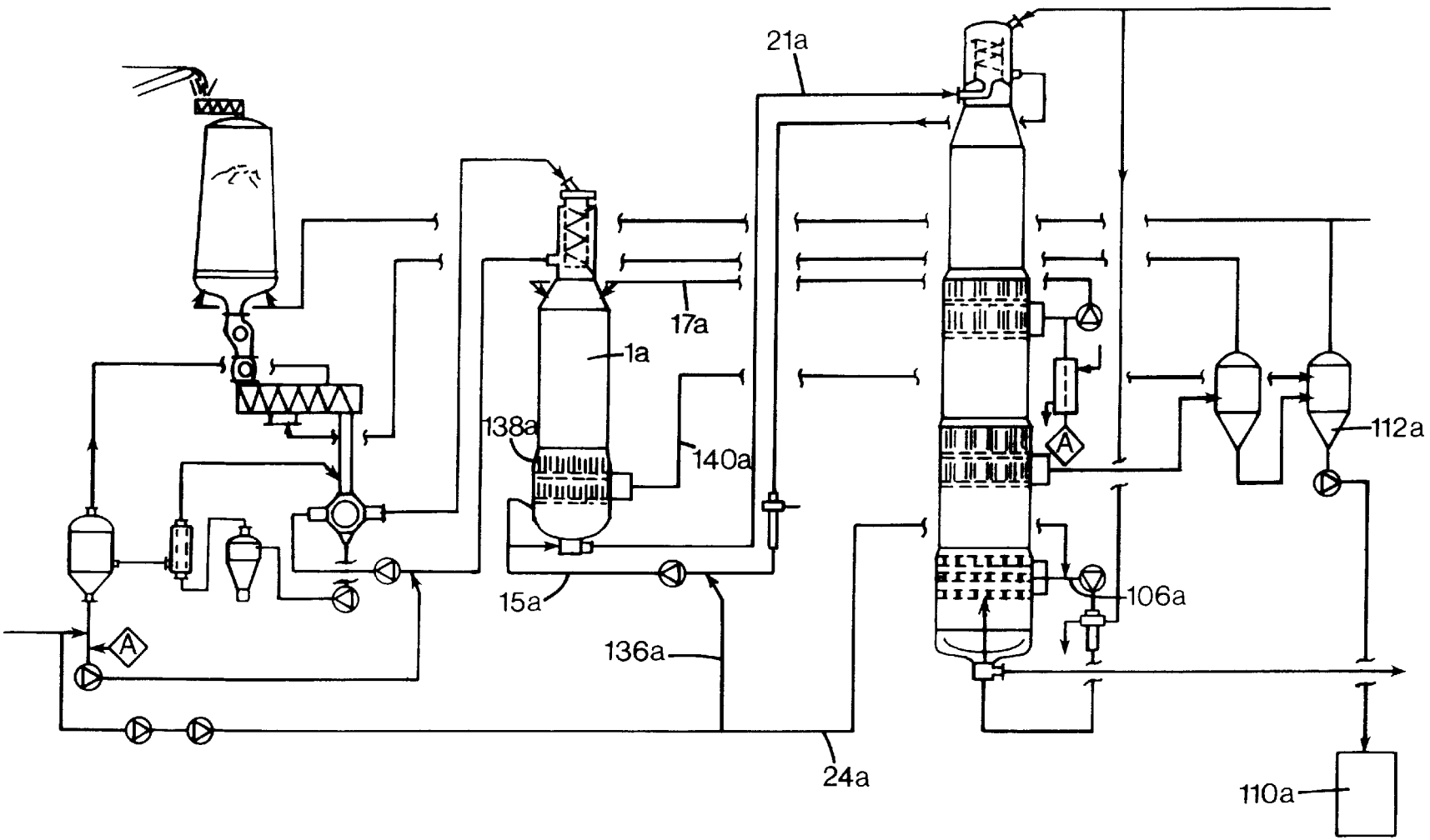
FIG. 3 is a schematic flow diagram of a preferred second embodiment of a digester system according to the present invention.

In FIG. 3 a second embodiment of the present invention is shown. The second embodiment is virtually identical to the embodiment shown in FIG. 1. Only some of the most important differences are described herein. The impregnation vessel 1*a* has a screen girdle section 138*a* disposed at the bottom of the impregnation vessel 1*a* for withdrawing a second spent liquor. Normally, this embodiment applies to retrofit installations having an existing screen girdle at the bottom of the impregnation vessel. A conduit 140*a* is connected to the girdle section 138*a* and the flash tank 112*a*. The second spent liquor withdrawn from the section 138*a* has an effective alkaline level that is lower than the effective alkaline level of the first spent liquor that is conducted to the top of the impregnation vessel via the conduit 17*a*. In the preferred embodiment, the effective alkaline level of the second spent liquor is about 10 g/l or less. The second spent liquor is conducted to the flash tank 112*a* to be recovered in a recovery unit 110*a*.

A conduit 136*a* extends between the return conduit 15*a* and the conduit 24*a* so that a major portion of the white liquor in the conduit 24*a* is conducted via the conduit 136*a* to the return line 15*a*, which supplies it, indirectly, via the transport line 21*a* up to the top of the digester. The conduit 24*a* is connected to the conduit 106*a* for supplying a minor portion of the white liquor to the counter-current zone.

A branch conduit may be attached to the conduit 17*a* to divert a portion of the spent liquor to the high-pressure feeder via a cooler for supplying cooled black liquor.

Figure 4:
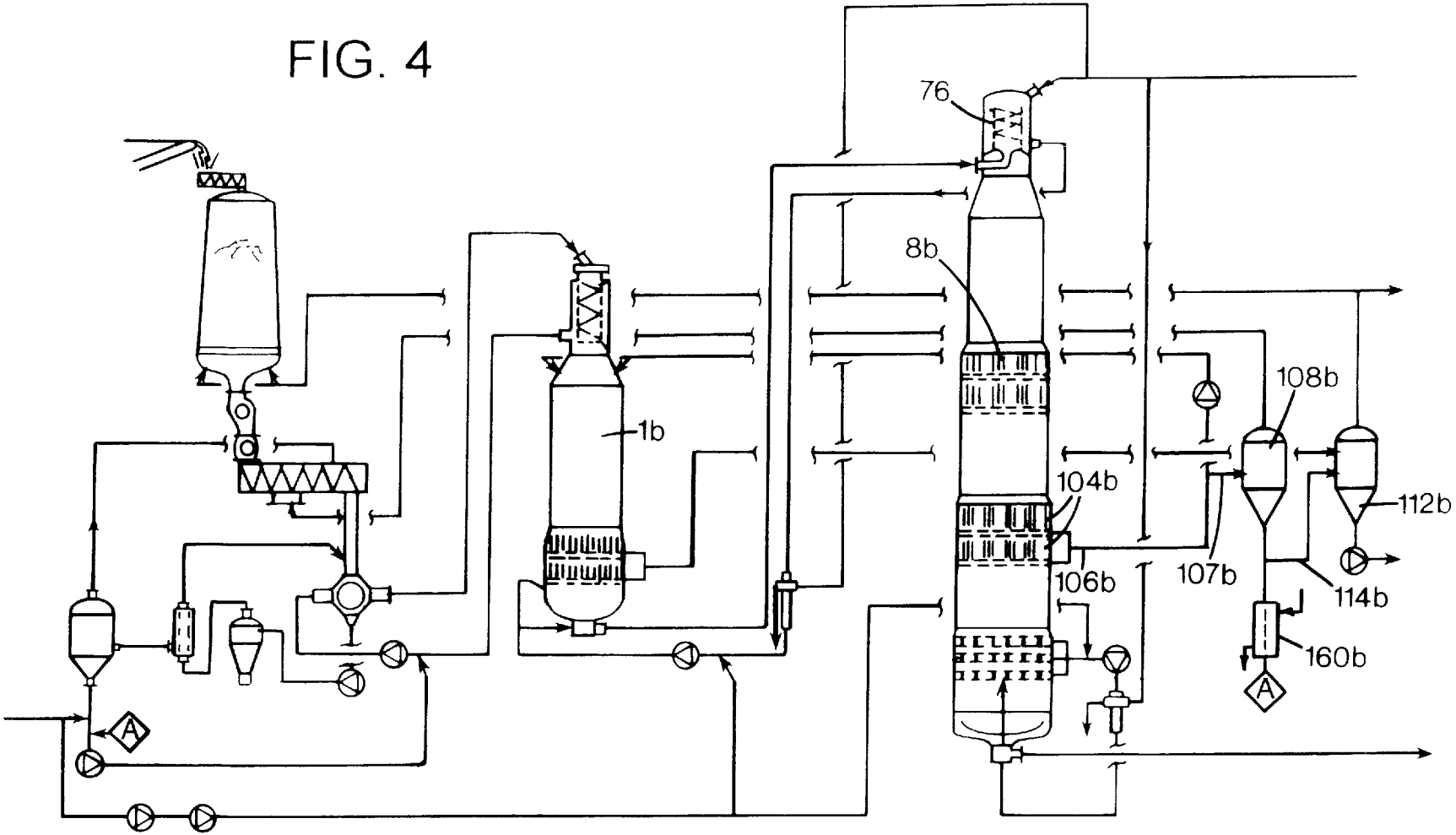
FIG. 4 is a schematic flow diagram of a preferred third embodiment of a digester system according to the present invention.

FIG. 4 illustrates a third embodiment of the present invention. Only some of the new features of this embodiment compared to the second embodiment are described. A conduit 106*b* conducts spent liquor that has been withdrawn from the screens 104*b* to the top of the impregnation vessel 1*b*. A portion of the spent liquor withdrawn in the conduit 106*b* is diverted via a conduit 107*b* to a first flash tank 108*b* and then via conduit 114*b* to a second flash tank 112*b*. A portion of the spent liquor in the conduit 114*b* is sent to a cooler 160*b* and, thereafter, back into the conduit 114*d*. If the digester is a retrofit, the digester may include an upper screen girdle section 8*b* that does not serve any particular function.

Figure 5:
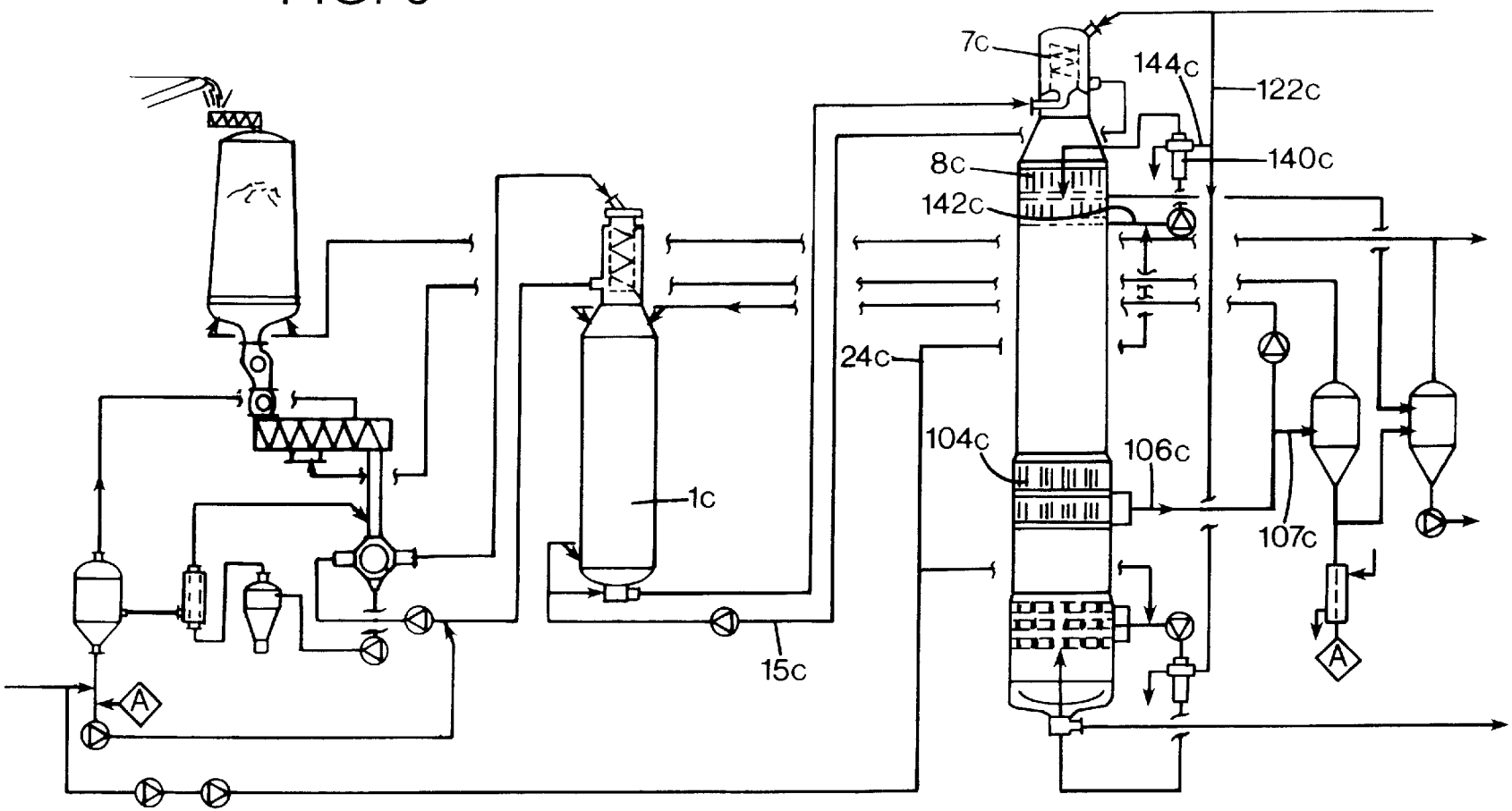
FIG. 5 is a schematic flow diagram of a preferred fourth embodiment of a digester system according to the present invention.

FIG. 5 shows a fourth embodiment of the present invention. A conduit 24*c* conducts white liquor to a circulation line 142*c*. Liquor is withdrawn from a screen girdle section 8*c* and is reintroduced by means of a central pipe together with the white liquor from the conduit 24*c* into a zone of the digester 6*c* that is disposed adjacent to or within the girdle section 8*c*. It should be noted that the screen girdle section 8*c* is substantially closer to the separator 7*c* than the screen girdle section 8*b* is to the separator 7*b*, as shown in FIG. 4. In the preferred fourth embodiment, the temperature of the liquor in the conduit 142*c* is regulated by a heat exchanger 140*c*. The heat exchanger 140*c* is connected to the steam of a conduit 122*c* via a branch conduit 144*c*. The remaining portion of the fourth embodiment is almost identical to the embodiment shown in FIG. 4. However, the preferred fourth embodiment has an impregnation vessel 1*c* that lacks a screen section at the bottom of the impregnation vessel similar to the impregnation vessel shown in FIG. 1. It is to be understood that the screen girdle section 8*c* may be shut off from the digester 6*c*. If the screen girdle section 8*c* is shut off from the digester 6*c*, then the conduit 24*c* extends to the top of the digester 6*c* in a manner similar to the conduit 24 shown in FIG. 1. In such a case, the spent liquor that is conducted to the recovery unit would have to be branched off from the return line 15*c* as shown in FIG. 1. Further, as a way of alternative, such a branch off line could also be used in the embodiment shown in FIG. 5, whereby no or little spent liquor would have to be withdrawn from the digester and conducted to the flash tank. The conduit 24*c* may be associated with a heat exchanger to regulate the temperature of the white liquor before the white liquor enters the top of the digester 6*c*. The heat exchanger may in turn be connected to the conduit 122*c* to receive steam.

Figure 6:
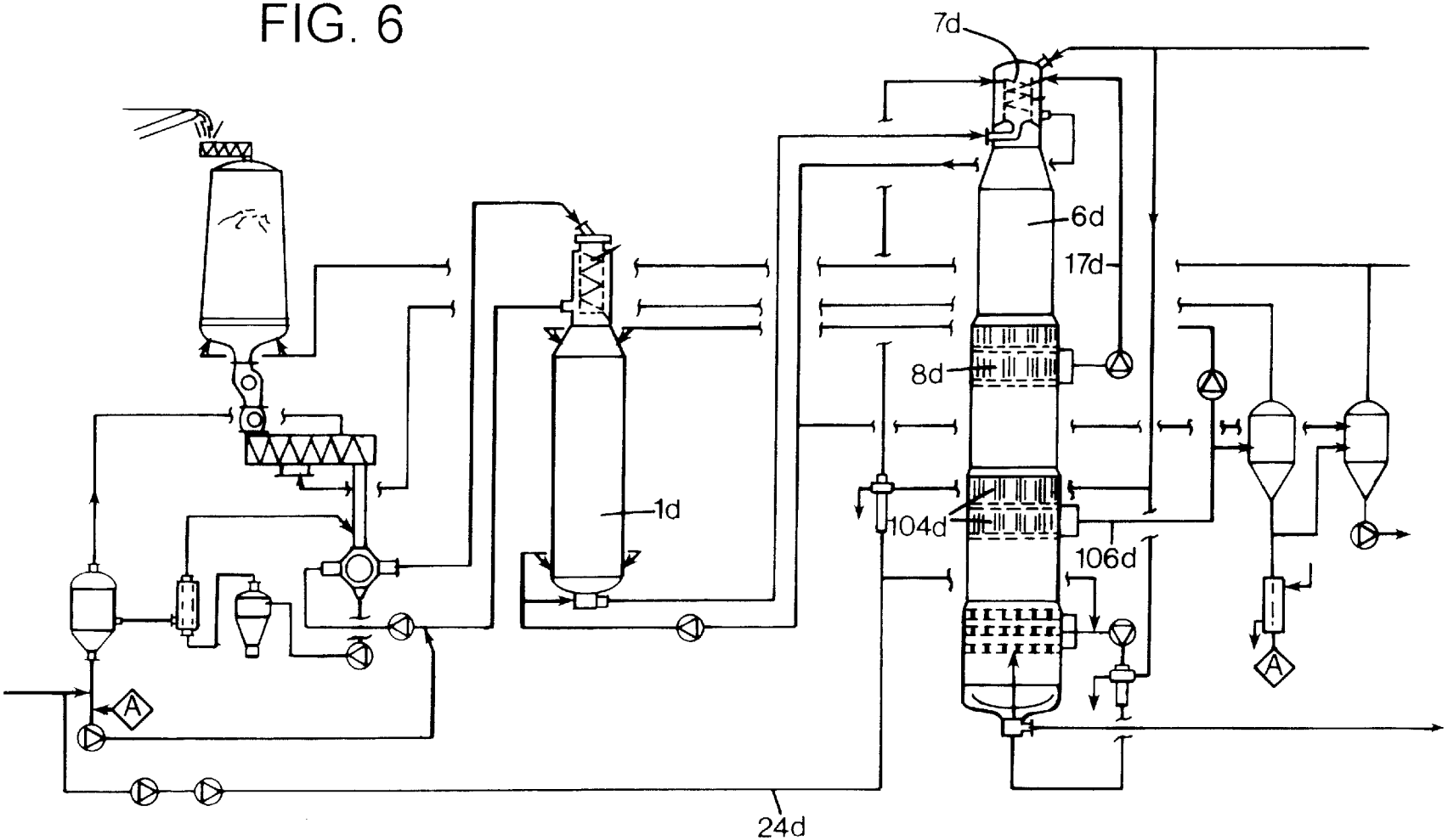
FIG. 6 is a schematic flow diagram of a preferred fifth embodiment of a digester system according to the present invention.

FIG. 6 shows a fifth embodiment of the present invention. A conduit 24*d* conducts white liquor to the top of the digester 6*d* similar to the manner described in the earlier embodiments. Spent liquor is withdrawn from a screen girdle section 8*d* and is recirculated back to a top separator 7*d* via a conduit 17*d* in order to provide sufficient amount of free liquor in the chips pile to prevent the white liquor (which is supplied downstream of the black liquor supply) from flowing back and being withdrawn into the separator. The spent liquor forms a barrier between the white liquor and the separator. Spent liquor is also withdrawn at a screen girdle section 104*d* and conveyed via a conduit 106*d* back to a top portion of an impregnation vessel 1*d*. The effective alkaline of the black liquor that is withdrawn from 104*d* is above 13 g/l; preferably above 16 g/l. The remaining sections of the fifth embodiment are virtually identical to the earlier described embodiments.

Figure 7:
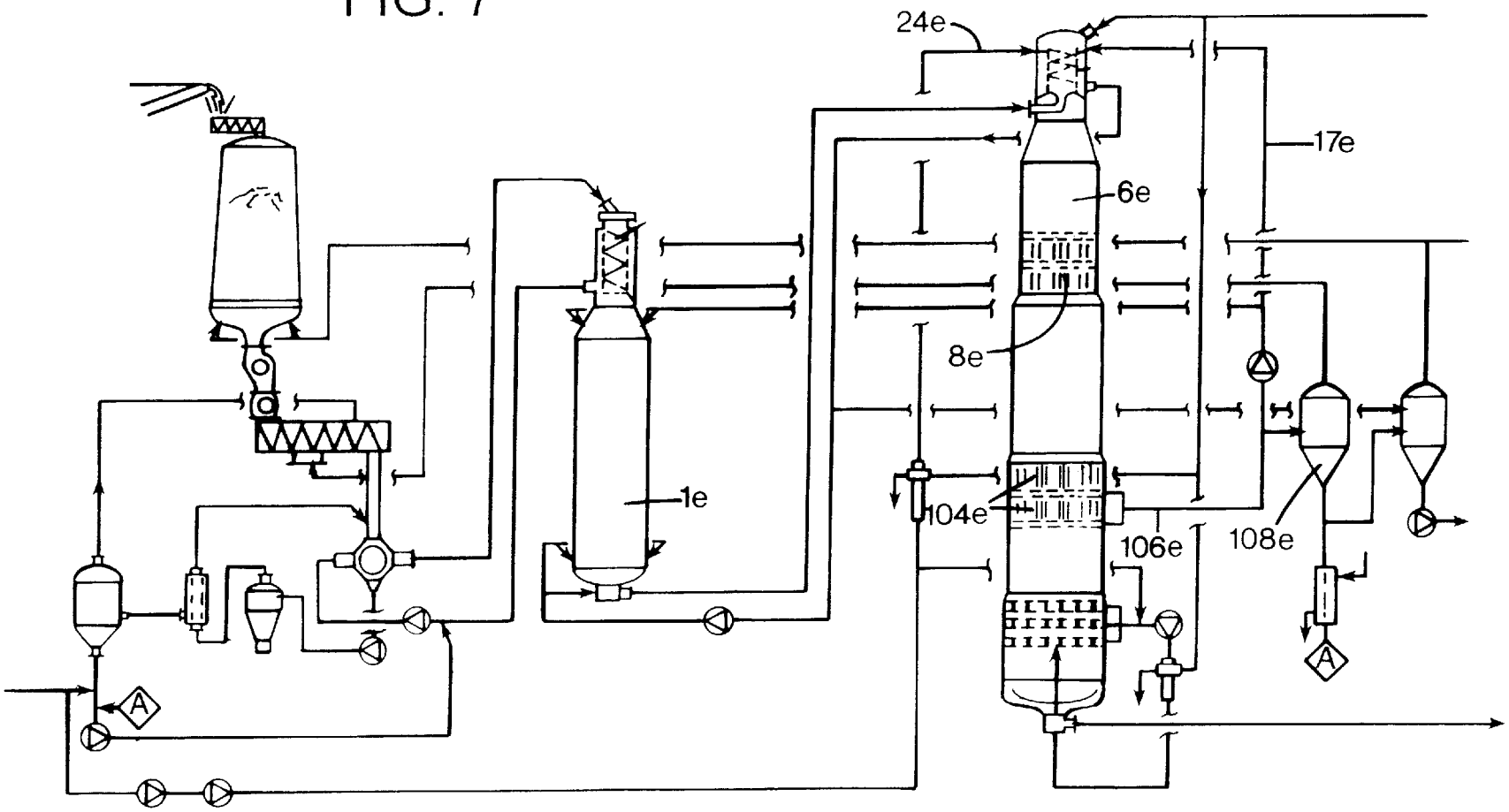
FIG. 7 is a schematic flow diagram of a preferred sixth embodiment of a digester system according to the present invention.

FIG. 7 illustrates a sixth embodiment of the present invention. A digester 6*e* has an upper screen girdle section 8*e* shut off so that spent liquor is only drawn off from a screen section 104*e* via a conduit 106*e* and conducted back to a top portion of an impregnation vessel 1*e*. A branch conduit 17*e* is connected with the conduit 106*e* so that a first portion of the spent liquor is reintroduced to a top portion of the digester 6*e*. In this way, the fiber material, firstly, has had the transport liquid drawn off during its feeding upwardly by the top separator 7*e* and, secondly, the fiber material encounters the black liquor (e.g. 0.5 $m^3$/ADT) introduced via the conduit 17*e* and, thirdly, the white liquor is introduced via the conduit 24*e*. A second portion of the spent liquor in the conduit 106*e* is conveyed to the top of the impregnation vessel 1*e*. A third portion of the spent liquor is conducted to the flash tank 108*e*. The second portion represents a major portion of the spent liquor such as about 90% of the black liquor. The remaining sections of the embodiment are similar to the embodiment of FIG. 6.

Figure 8:
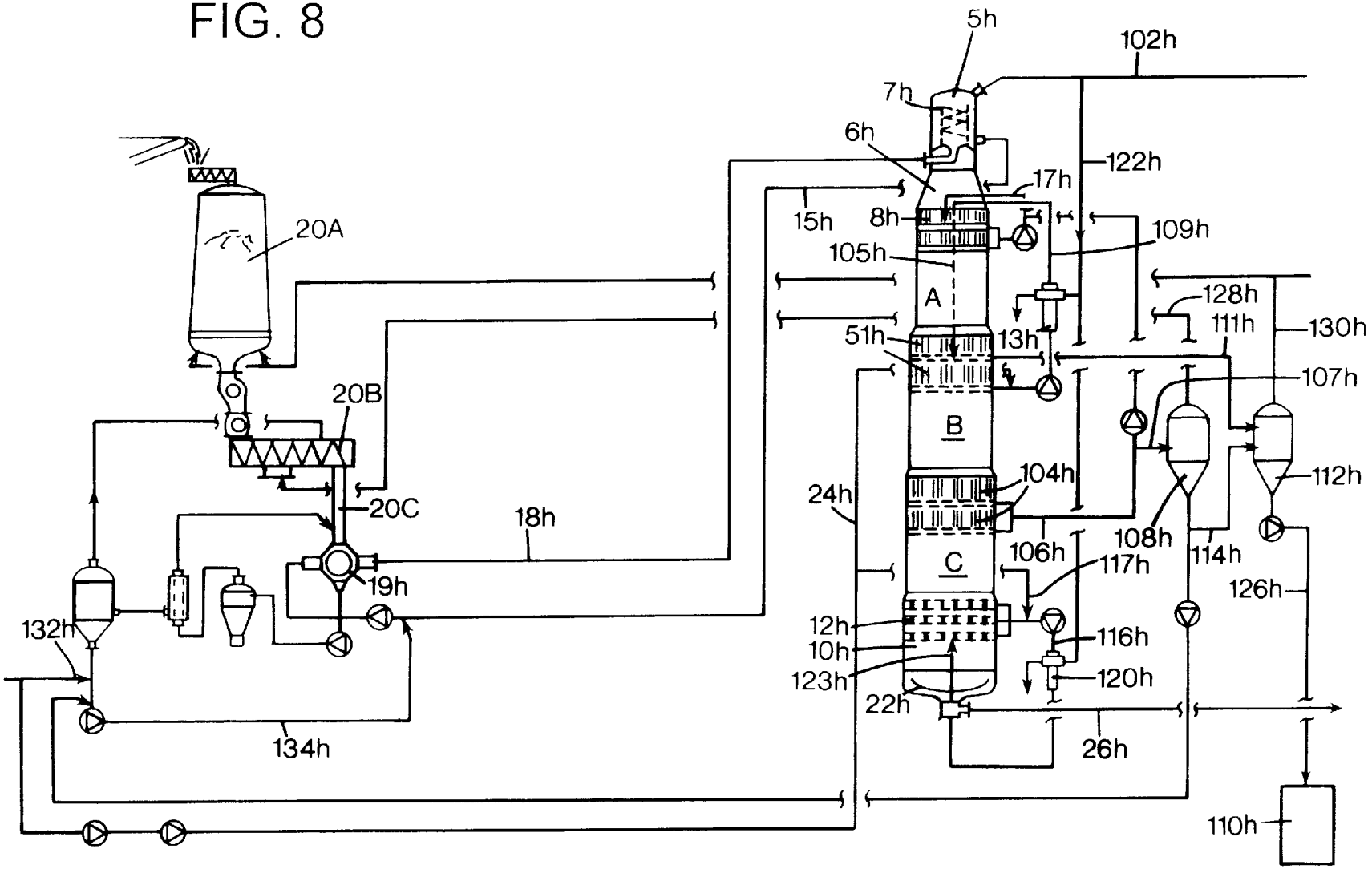
FIG. 8 is a schematic flow diagram of a preferred seventh embodiment of a digester system according to the present invention.

FIG. 8 illustrates a seventh embodiment of a digester system of the present invention. This embodiment is a single vessel steam/liquid phase digester system. The chips are fed from a chip bin 20A, through a steaming vessel 20B and a chip chute 20C. A feeding device, preferably a high-pressure feeder 19*h* feeds the chips suspended in a transport liquid D via a conduit 18*h* to the top of a digester 6*h*. The feeder 19*h* is cooperating with the chute 20C, and is connected to the necessary licuid circulations and replenishment.

The conduit 18*h* extends from the feeder 19*h* up to a top 5*h* of the digester 6*h*. The conduit 18*h* may open up at the bottom of a top separator 7*h* that feeds by means of a screw in an upwardly moving direction. The separator 7*h* is preferably identical or very similar to the top separator 7 that is shown in FIG. 2 and described in detail above. The screen of the separator may be used to draw off the transport liquid D (which is then returned in a return line 15*h*) together with which the chips are transported from the feeder 19*h* up to the top 5*h* of the digester 6*h*. A first screen girdle section 8*h* may be disposed immediately below or adjacent the separator 7*h*. A recirculation line 17*h* may withdraw liquor and bring it back to a space that is defined between the first screen girdle section 8*h* and the separator 7*h*. The recirculation improves the distribution of the liquor in the digester.

A second screen girdle section 51*h* is disposed below the first screen girdle section 8*h* so that an impregnation zone A is defined between the screen girdle sections 8*h* and 51*h*. We have found indications that it is desirable to keep the alkaline level at above at least 2 g/l, preferably above 4 g/l, in the impregnation zone A in connection with black liquor, which would normally correspond to a pH of about 11. If not, it appears that dissolved lignin precipitate and even condense. Spent liquor may be withdrawn from the upper screen of the section 51*h* and conducted with a conduit 111*h* to a second flash tank 112*h*. Spent liquor is withdrawn via a conduit 109*h* from a lower screen of the section 51*h* and conducted back to the space defined above the first screen girdle section 8*h* so that the spent liquor may be reintroduced back to the lower screen of the second screen girdle section 51*h* via a central pipe 105*h*. The temperature of the spent liquor may be controlled by a heat exchanger 13*h*. The heat exchanger 13*h* is in operative engagement with a high pressure steam line 102*h* via a conduit 122*h*.

A cooking liquor conduit 24*h* is operatively attached to the conduit 109*h* to supply a cooking liquor, such as white liquor, to the conduit 109*h*. The effective alkali of the liquor in the conduit 109*h* is at least about 13 g/l; more preferably at least about 16 g/l; and, most preferably, between about 13 g/l and about 30 g/l.

Approximately 95% of the total supply of the white liquor is conducted in the conduit 24*h* and the remaining 5% is supplied to the high pressure feeder 19*h* via a conduit 132*h* and a conduit 134*h* to lubricate the high pressure feeder 19*h*.

A third screen girdle section 104*h* may be arranged below the second screen girdle section 51*h* so that a concurrent cooking zone B is defined between the screen girdle sections 51*h* and 104*h*. Draw-off from the third screen section 104*h*, such as spent liquor, i.e., black liquor, may be conducted via a conduit 106*h* back to the conduit 17*h*. The effective alkali of the spent liquor conducted in the conduit 106*h* is about ?? g/l. A portion of the black liquor in the conduit 106*h* may be conducted to a first flash tank 108*h* via a conduit 107*h* to cool the spent liquor before the liquor is conducted to a recovery unit 110*h*. Preferably, the spent liquor is also conducted through a second flash tank 112*h* via a conduit 114*h* to further reduce the temperature and pressure of the spent liquor before the liquor is conducted to the recovery unit 110*h*. The spent liquor from both flash tanks 108*h*, 112*h* are then conducted with a conduit 126*h* to the recovery unit 110*h*. Conduits 128*h* and 130*h* may be connected to the flash tanks 108*h*, 112*h*, respectively, to provide steam that is sent to the chip bin 20A and the steaming vessel 20B.

At a bottom 10*h* of the digester 6*h*, there is a feeding-out device including a scraping element 22*h*. A fourth lower screen girdle section 12*h* is disposed at the bottom 10*h* of the digester 6*h* so that a counter-current cooking zone C is defined between the sections 104*h* and 12*h*. The girdle section 12*h* may, for example, include three rows of screens for withdrawing liquid, which is heated and to which some white liquor, preferably about 10% of the total amount of the white liquor in the conduit 24*h*, is added via a branch conduit 117*h* before it is recirculated by means of a central pipe 123*h*, which opens up at about the same level as the lowermost strainer girdle 12*h*.

The draw-off from screen girdles 12*h* and the white liquor from the branch conduit 117*h* are preferably conducted via a heat exchanger 120*h* back to the bottom 10*h* of the digester 6*h*. The conduit 122*h* is connected to the heat exchanger 120*h* to provide the heat exchanger 120*h* with steam to regulate the temperature of the white liquor in the conduit 116*h*. The temperature of this draw off is about ??° C. The white liquor is supplied in a counter-current direction via the central pipe 123*h* to the screen girdle section 12*h*. The white liquor provides fresh alkali and, in the form of counter-current cooking, further reducing the kappa number. A blow line 26*h* may be connected to the bottom 10*h* of the digester for conducting the digested pulp away from the digester 6*h*.

A preferred installation according to the present invention, as shown in FIG. 8, may be described as follows. The chips are fed into the chip bin 20A and are subsequently steamed in the vessel 20B and, thereafter conveyed into the chute 20C. The high-pressure feeder 19*h*, which is supplied with a minor amount of white liquor (approximately 5% of the total amount to lubricate the feeder), feeds the chips into the conduit 18*h* together with the transport liquid. The slurry of chips and the liquid are fed to the top of the digester 6*h* and may have a temperature of about 110–120° C. when entering the digester 6*h* (excluding recirculated transport liquor).

Inside the top of the digester 6*h*, there is the top separator 7*h* that pushes chips in an upward direction through the separator and then the chips move slowly downwards in a plug flow through the impregnation zone A in a liquid/wood ratio between 2/1–10/1 preferably between 3/1–8/1, more preferred of about 4/1–6/1. The liquor, which is drawn off from the screen girdle section 8*h*, may be recirculated via the conduit 17*h* to the space below the top separator 7*h*. The chips are then thoroughly impregnated in the impregnation zone A.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation zone A may be larger than 1/11, preferably larger than 1/10 of the volume of the digester 6*h*. Additionally, in the preferred embodiment, the volume V of the impregnation zone A should exceed 5 times the value of the square of the maximum digester diameter, i.e., $V=5D^2$, where D is the maximum diameter of the digester 6*h*.

The chips, which have been thoroughly impregnated and partially delignified in the impregnation zone A, are then passed into the concurrent cooking zone B.

A spent liquor is withdrawn at the upper segment of the screen section 51*h* and conducted to the second flash tank 112*h*. A spent liquor is also withdrawn at the lower segment of the section 51*h* and reintroduced via the central pipe 105*h* with the addition of white liquor supplied by the conduit 24*h*.

The chips move down in the concurrent zone B through the digester 6*h* at a relatively low cooking temperature, i.e., between 130–160° C., preferably about 140–150° C. The major part of the delignification takes place in the first concurrent cooking zone B.

The liquid-wood ratio should be at least 2/1 and should be below 7/1, preferably in the range of 3/1–5.5/1, more preferred between 3.5/1 and 5/1. (The liquid wood-ratio in the counter-current cooking zone should be about the same as in the concurrent cooking zone.)

The temperature in the lower counter-current zone C is preferably higher than in the concurrent zone B, i.e., preferably exceeding 140° C., preferably about 145–165° C., in order to dissolve remaining lignin. The alkali content in the lowermost part of the counter-current cooking zone C should preferably be lower than in the beginning of the concurrent zone B, above 5 g/l, but below 40 g/l. Preferably less than 30 g/l and more preferred between 10–20 g/l. In the preferred case, the aim is to have a temperature difference of about 10° C. between the concurrent zone B and the counter-current cooking zone C. Expediently, the conduit 116*h* may be charged with about 5–20%, preferably 10–15%, white liquor from the conduit 24*h* via the conduit 117*h*.

The temperature of the liquid which is recirculated via the pipe 123*h* up to the screen girdle section 12*h* is regulated with the aid of the heat exchanger 120*h* so that the desired cooking temperature is obtained at the lowermost part of the counter-current cooking zone.

Figure 9:
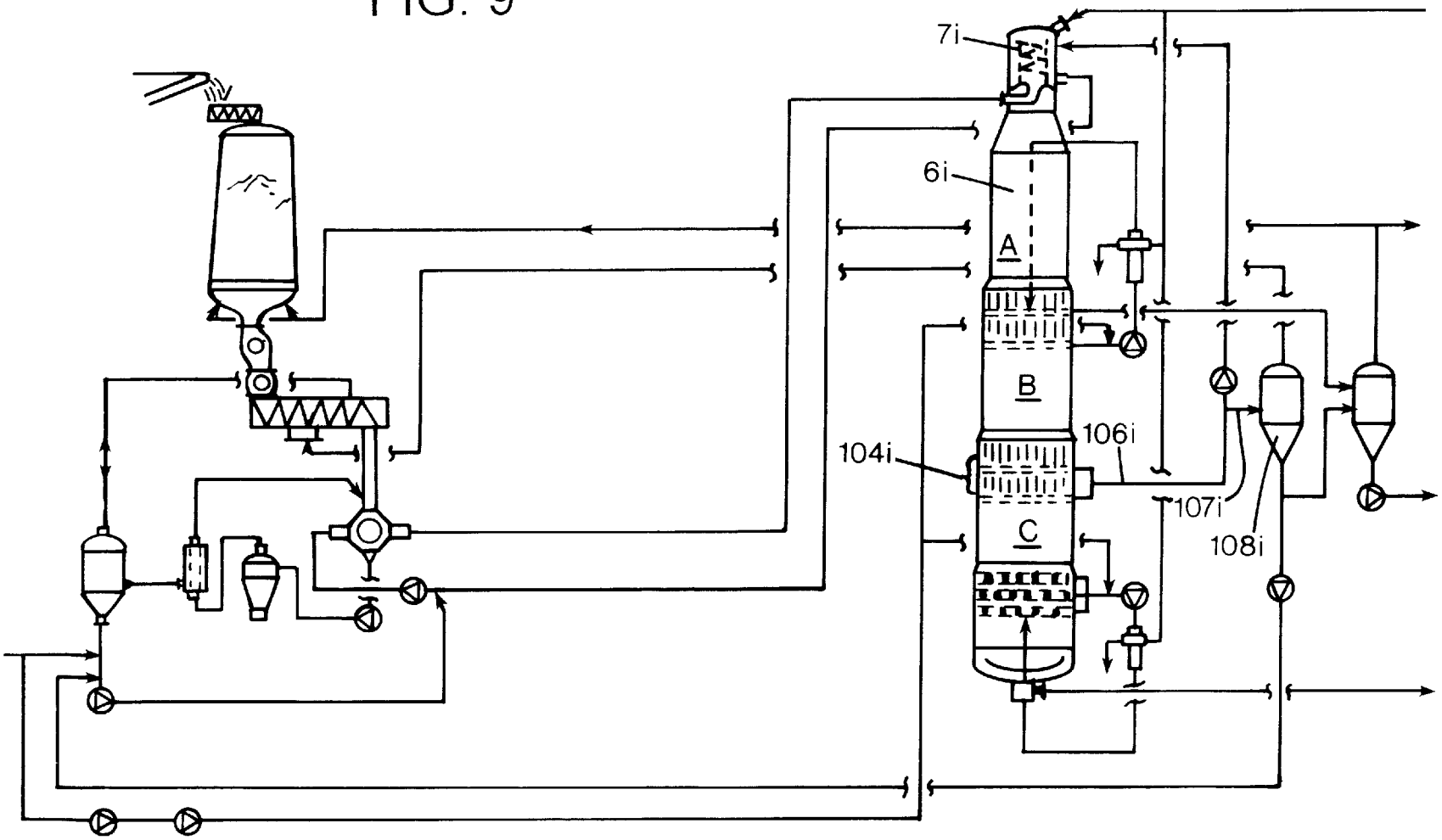
FIG. 9 is a schematic flow diagram of a preferred eighth embodiment of a digester system according to the present invention.

FIG. 9 illustrates a eighth embodiment of the digester system of the present invention. This embodiment is very similar to the seventh embodiment but it lacks a screen girdle section immediately below the top separator. Only the most important differences are described herein. Spent liquor is withdrawn from a screen girdle section 104*i* disposed in a digester 6*i* and conducted with a conduit 106*i* back to a point above a top separator 7*i*. A portion of the spent liquor in the conduit 106*i* may be conducted via a conduit 107*i* to a first flash tank 108*i*, as described earlier.

Figure 10:
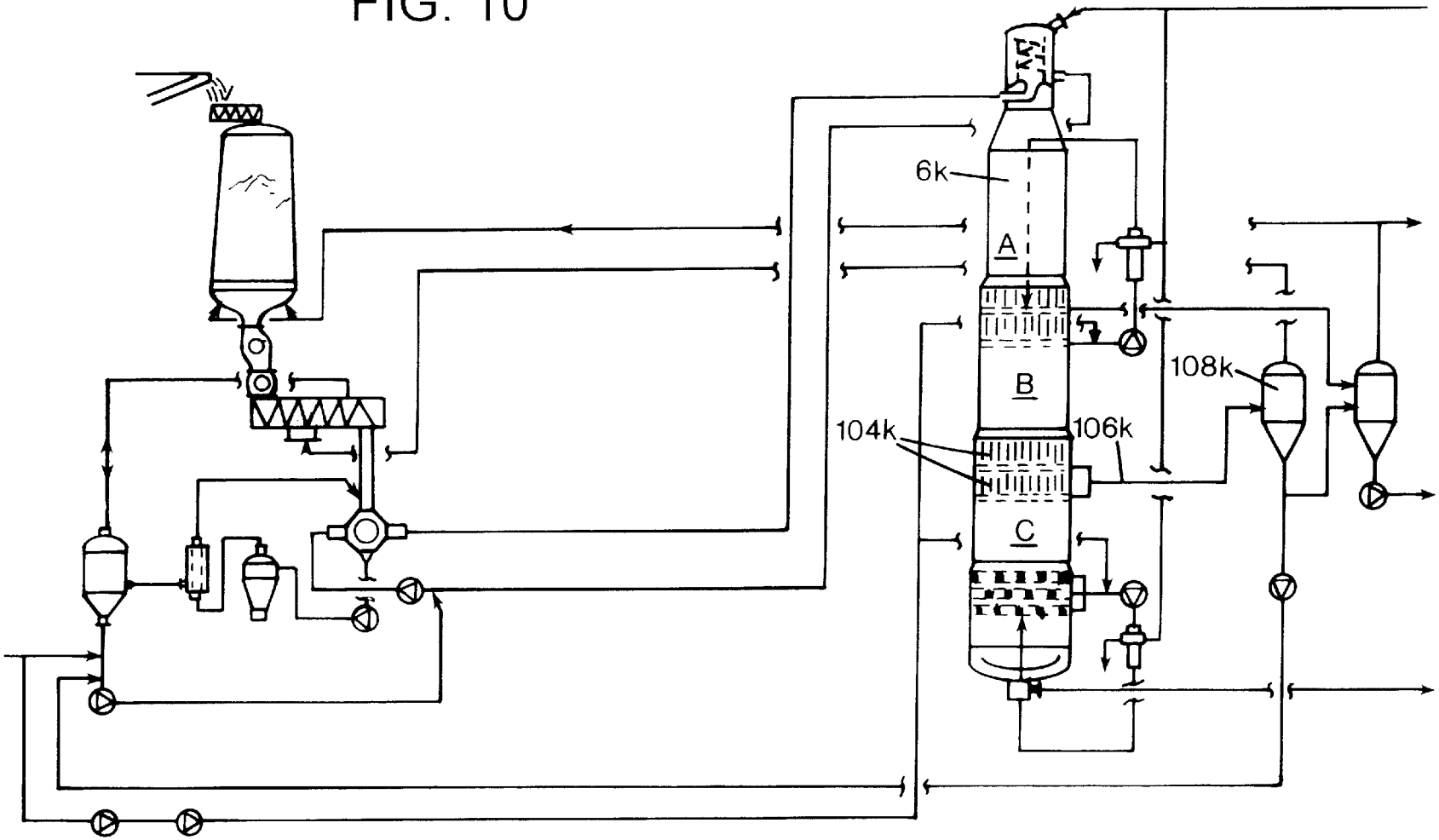
FIG. 10 is a schematic flow diagram of a preferred ninth embodiment of a digester system according to the present invention.

FIG. 10 shows an ninth embodiment of the present invention. This embodiment is almost identical to the eighth embodiment described in FIG. 9. However, all of the spent liquor withdrawn from a screen girdle section 104*k* inside a digester 6*k* is conducted via a conduit 106*k* to a flash tank 108*k* and then further conducted to a recovery unit.

Figure 11:
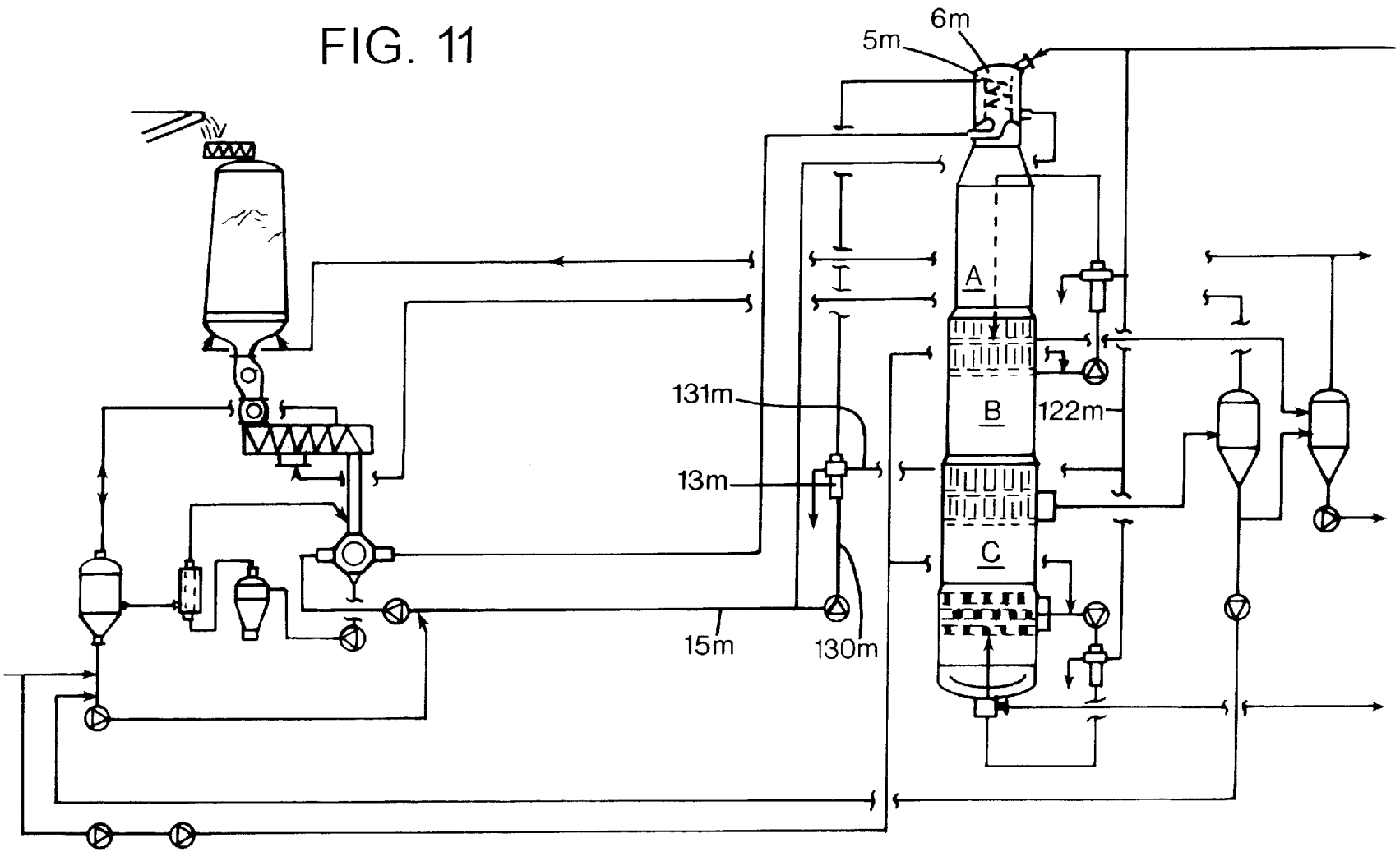
FIG. 11 is a schematic flow diagram of a preferred tenth embodiment of a digester system according to the present invention.

FIG. 11 depicts a tenth embodiment of the present invention that is virtually the same as the ninth embodiment. The tenth embodiment has a conduit 130*m* that extends between a return line 15*m* and a top section 5*m* of a digester 6*m* to divert a portion of the liquid in the return line 15*m* and bring it back up to the top of the digester 6*m*. A heat exchanger 13*m* is in operative engagement with the conduit 130*m* so that the temperature of the liquid in the conduit 130*m* may be controlled. A branch steam conduit 131*m* extends from a conduit 122*m* to the heat exchanger 13*m*.

Figure 12:
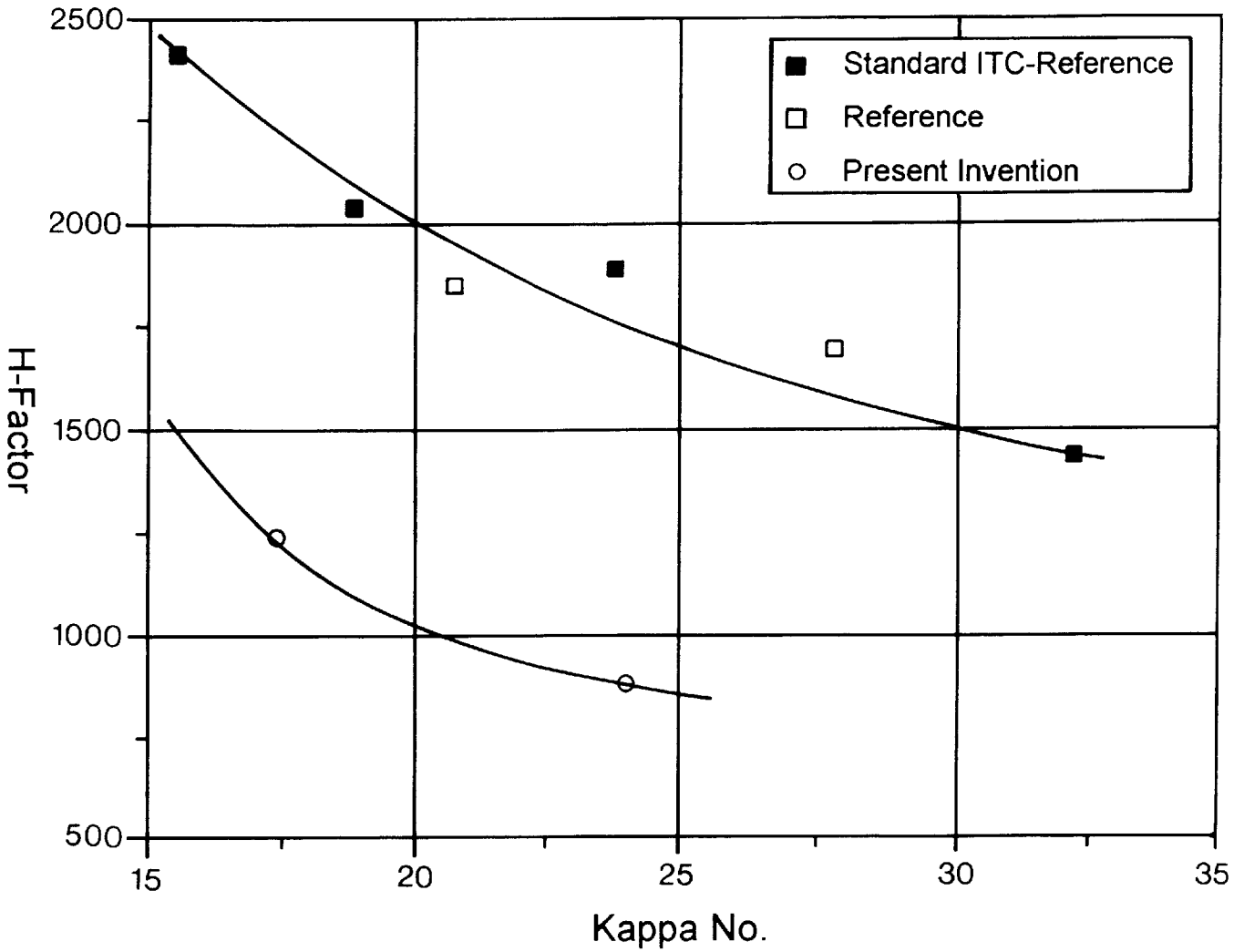
FIG. 12 shows a diagram presenting the advantages related to the H-factor when using the invention.

In FIG. 12, there is shown a diagram comparing the H-factor for pulp produced according to a conventional ITC™-cooking process and according to the cooking process of the present invention. The H-factor is a function of time and temperature in relation to the delignification process (degree of delignification) during the cooking process. The H-factor is used to control the delignification process of a digester, i.e., maintaining a certain H-factor principally leads to the same Kappa number of the produced pulp (remaining lignin content of the fiber material) independent of any temperature variations during the cooking process.

In FIG. 13, it is shown that the H-factor for pulp produced according to the present invention is extremely much lower (about 40–50% lower) compared to pulp produced according to ITC™. This means that much lower temperatures may be used for the same retention time in order to reach a certain degree of delignification (Kappa number) and/or that smaller vessels for the cooking within a continuous digester can be used and/or that a lower Kappa number may be achieved with the same kind of basic equipment and/or that higher rate of production can be obtained.

The lower H-factor demand is achieved by a high alkali concentration and a low cooking temperature in the concurrent cooking zone, which presents one reference ITC-cook (ITC 1770) and one cook according to the present invention (modified ITC* 1763). As shown, the temperature in the counter-current cooking zone, according to the present invention, is higher than in the concurrent zone but still lower than the temperature in the counter-current zone in the ITC-reference.

Figure 14:
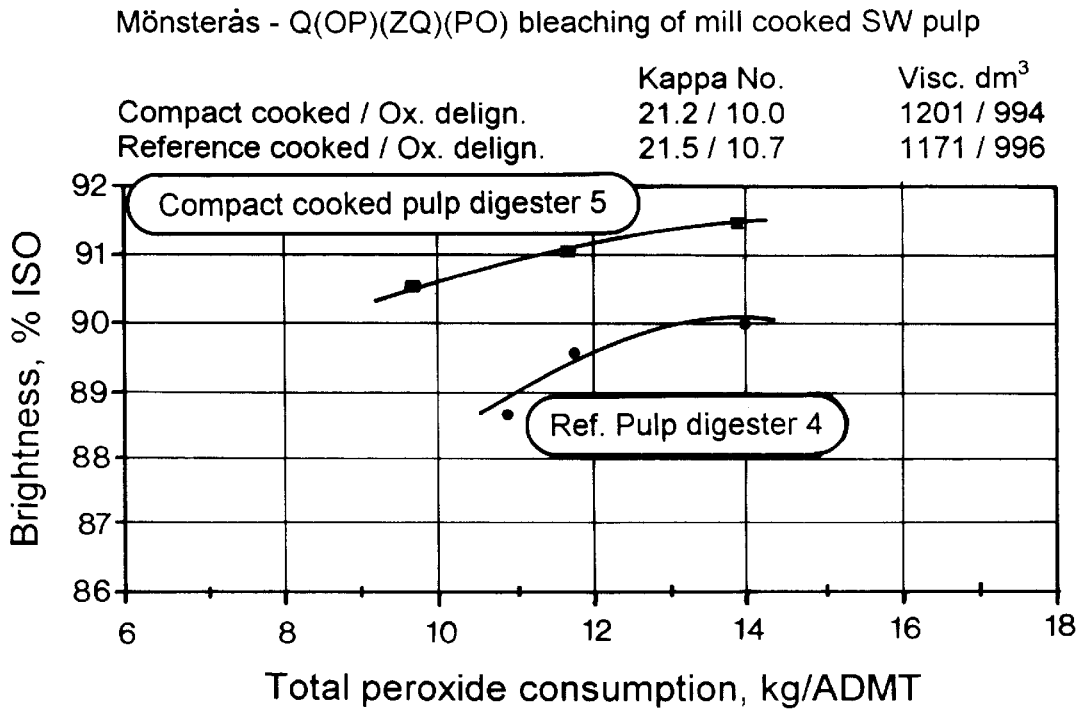
FIG. 14 shows test data related to peroxide consumption and brightness for the present compact method compared to a conventional process.

FIG. 14 shows results from TCF bleaching using the cooking process (s.c "compact") of the present invention compared to a conventional reference cooking process. The present invention provides a TCF-bleached pulp having extremely good bleachability—a higher brightness is achieved compared to the conventional process for the same amount of peroxide consumption, and also a higher brightness ceiling is obtained.

Figure 15:
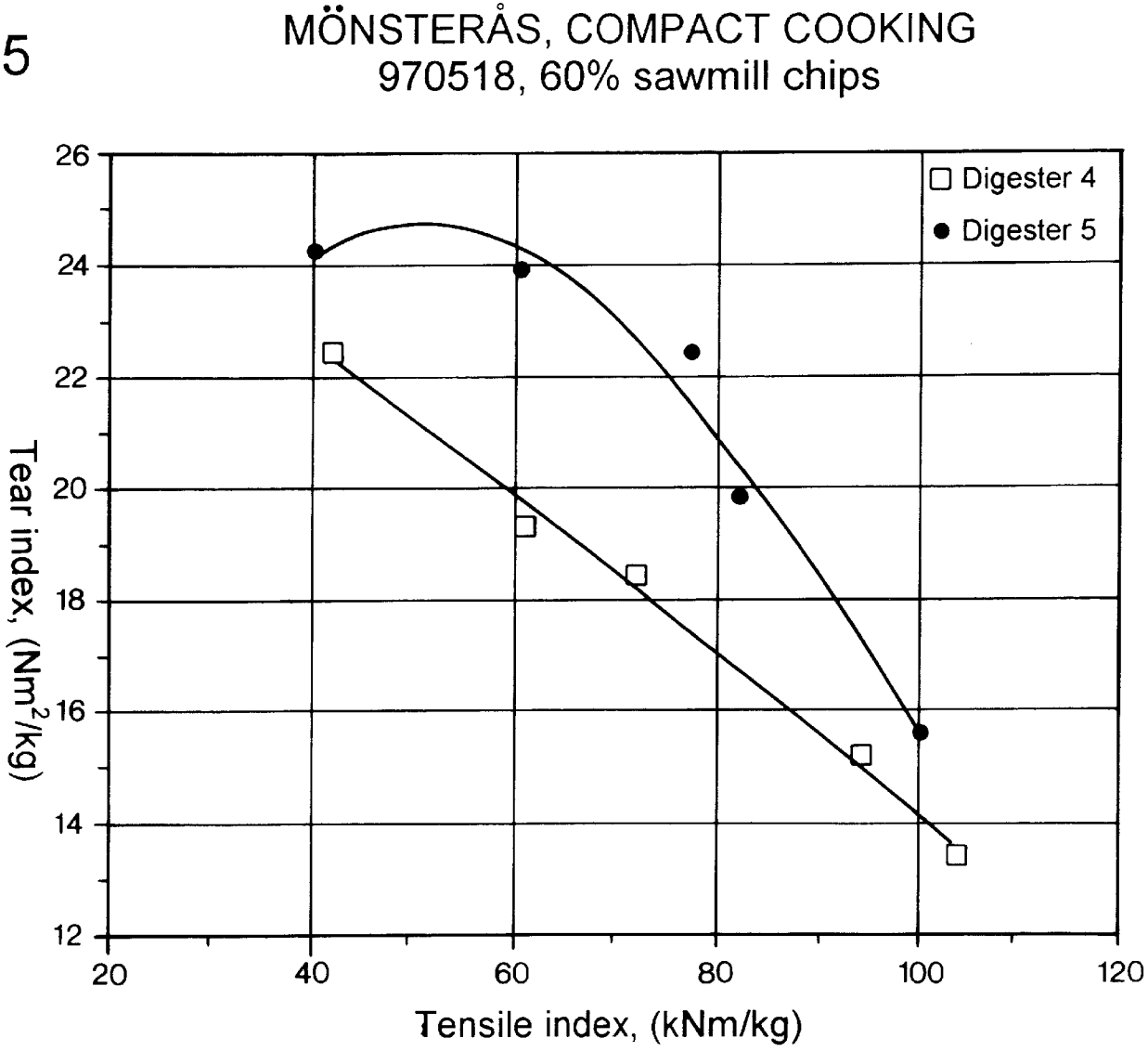
FIG. 15 shows test data related to tensile index and tear index for the present compact method compared to a conventional process.

FIG. 15 shows the tear index relative to the tensile index. The test data that are related to the digester 5 are using the cooking process of the present invention and the conventional cooking process was using in the digester 4.

Figure 16:
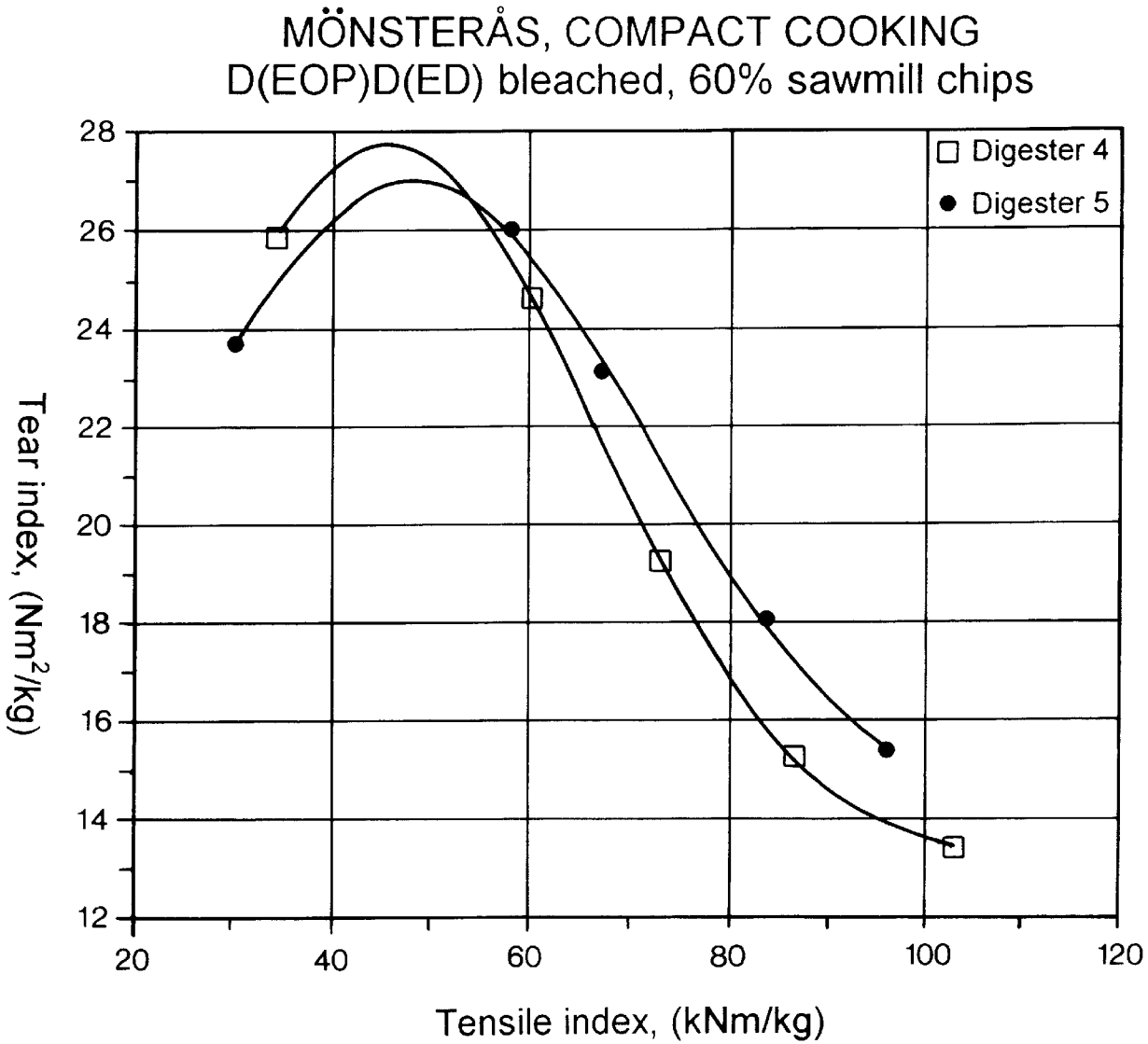
FIG. 16 shows test data related to tensile index and tear index for the present compact method compared to a conventional process.

Similarly, FIG. 16 illustrates test data for the digester 5 (the present invention) and the digester 4. The present invention exhibits better tensile index compared to the conventional method used in the digester 4.

Figure 17:
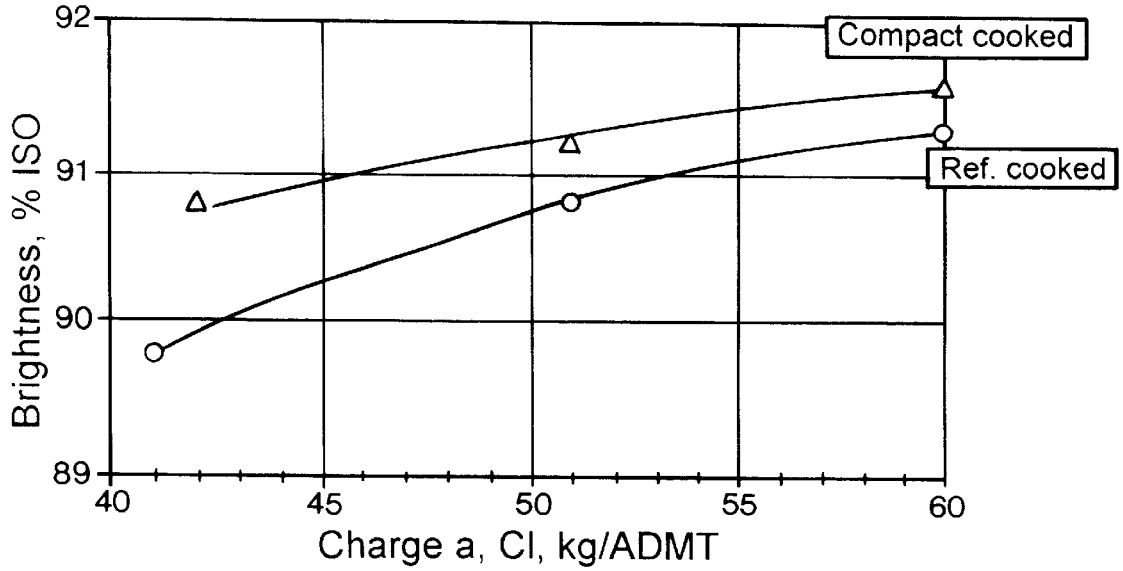
FIG. 17 shows test data related to Cl charge and brightness for the present compact method compared to a conventional process.

FIG. 17 shows the brightness level by using compact cooked (the present invention) and reference cooked pulp (conventional process). The cooking process of the present invention exhibits a higher brightness compared to the conventional cooking process.

Figure 18:
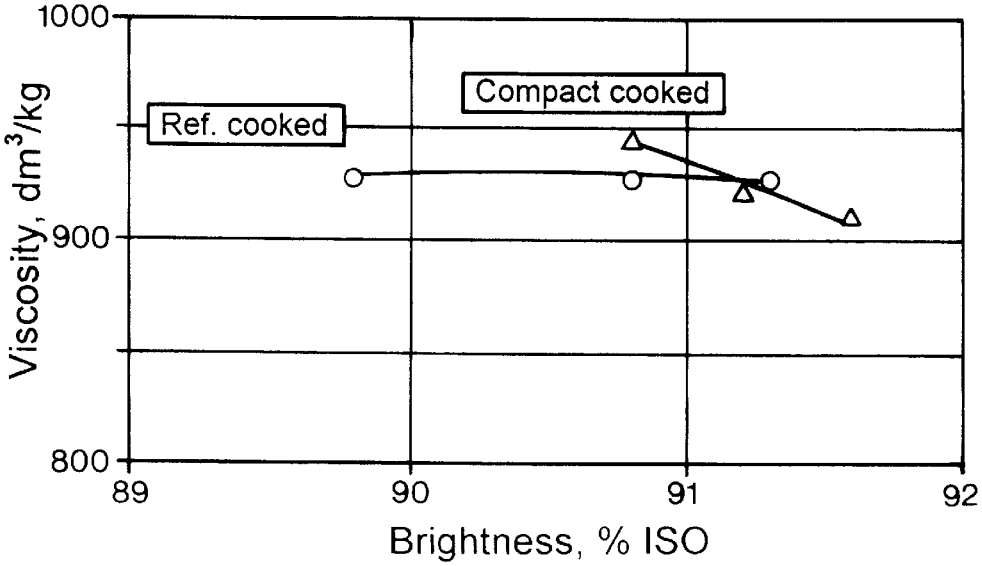
FIG. 18 shows test data related to brightness and viscosity for the present compact method compared to a conventional process.

Similarly, FIG. 18 shows the brightness level relative to the viscosity of the pulp by using the cooking process of the present invention (compact cooked) compared to a conventional process (reference cooked). It can be seen that the invention provides a pulp having a higher viscosity at the same brightness.

Figure 19:
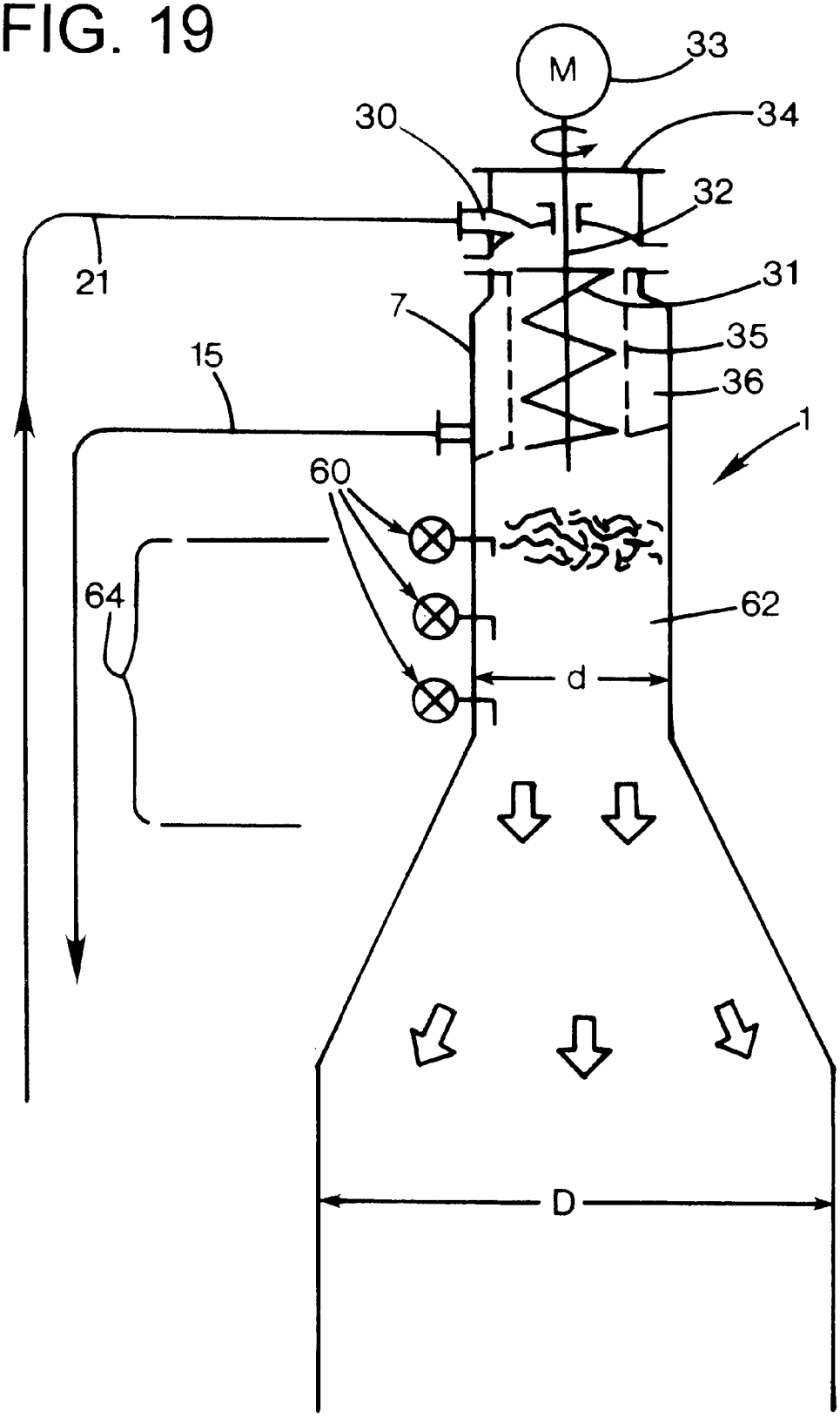
FIG. 19 is a cross-sectional view of an alternative embodiment of a top separator to be used in an impregnation vessel that is connected to the digester system of the present invention.

FIG. 19 illustrates a top separator that may be mounted in the impregnation vessel that is connected to the steam/liquid phase digester system of the present invention. Only a portion of the top portion of the impregnation vessel 1 is shown. The non-impregnated slurred fiber material is transferred to the top of the impregnation vessel by means of the transfer line 21 and enters an in-let space 30 of a screw-feeder 31. The screw-feeder 31 is attached to a shaft 32 connected to a drive-unit 33 which is attached to a mounting-plate 34 at the top of the impregnation vessel shell 1. The drive-shaft 32 is rotated in a direction so as to force the screw to feed the chips and the transport fluid in a downward direction.

A cylindrical screen-basket 35 surrounds the screw-feeder 31. The screen-basket 35 is arranged within the impregnation vessel shell 1 so as to define a liquid collecting space 36 between the impregnation vessel shell and the outer surface of the screen-basket 35. The liquid collecting space 36, which preferably is annular, communicates with a conduit 15 for withdrawing liquid from the liquid collecting space 36, which in turn is replenished by liquid from the slurry within the screen basket 35. The major part of the free liquid within the slurry entering the screen basket is withdrawn into the liquid collecting space 36, but a small portion of free liquid, at least about 0.5 $m^3$/ADT should not be withdrawn from the slurry. The conduit 15 may extend back to a high pressure pump so that the liquid is conducted to the high pressure pump.

A set of level sensors 60 may be positioned along a side wall of the impregnation vessel 1 to sense the level in the impregnation vessel. The level sensors are disposed below the screw-feeder 31. A top section 62 of the impregnation vessel 1 has a diameter (d) that is less than a diameter (D) of the impregnation vessel at a mid-portion and bottom portion thereof. The diameter (d) is small to reduce or even avoid any substantial heat transfer to the T-C lines so that the T-C lines may maintain a temperature that is slightly above 100° C. In this way, a heat lock zone 64 may be formed along the level sensors 60.

The invention is not limited to that which has been shown above but can be varied within the scope of the subsequent patent claims. Thus, instead of the shown separator used with the hydraulic digester many alternatives may be used, e.g., instead of an annular supply arrangement a central pipe (as shown in WO-9615313) for supply of liquid at distance downstream of the separator device within chip pile adjacent the top of the digester.

Moreover, there are many ways of optimizing the conditions even further, e.g., new on-line measuring systems (for example using NIR-spectroscopy) provide for the possibility of exactly measuring specific contents of the fiber material and the liquids entering the digesting system, which will make it feasible to more precisely determine and control the supply/addition of specific fluids/chemicals and also their withdrawal in order to establish optimized conditions. Different kind of additives can be very beneficial to use, especially for example poly-sulphide which has a better effect in a low temperature environment than in high temperatures. Also AQ (Anthraquinone) would be very beneficial since it combines very well with high alkaline environments.

Furthermore, there are a multiplicity of alternatives for uniformly drenching the chips with white liquor at the top of the digester. For example, a centrally arranged inlet (as described in WO-having a spreading device can be contrived, which device, provides a mushroom-like film of liquid, as can a centrally arranged showering element or an annular pipe with slots, etc.

In addition, the number of screen girdles shown is in no way limiting for the invention but, instead, the number can be varied in dependence on different requirements. The invention is in no way limited to a certain screen configuration and it is understood that bar screens can be exchanged by, for example, such as screens having slots cut out of sheet metal. Also in some installations moveable screens are preferred.

Furthermore, in order to amplify the heat economy, measures can be taken which decrease heat losses from the digester, such as, for example, insulation of the digester shell and/or maximization of the volume in relation to the outwardly exposed surface, i.e., increasing the cross-sectional area.

The shown system in front of the digester is in no way limiting to the invention, e.g., it is possible to exclude the steaming vessel and have a direct connection between the chip bin (for example, a partly filled atmospheric vessel) and the chip chute. Furthermore, other kind of feeding systems than an high pressure feeder may be used, e.g., DISCFLO™-pumps).

In order to improve the distribution of the white liquor added at the top, it is possible to install a so called "quench circulation" which would recirculate a desired amount of liquid from below the top screen back to the annular pipe. For this purpose ordinary screens is not a requirement. Finally, it should be understood that the basic principle of the invention can be applied also in combination with a circulation (strainer and piping) on the impregnation vessel, even if this, of course, reduces the cost advantage.

Moreover, the invention can be used in digesters not having a distinguished counter-current cooking zone. For example, in some retrofits of digesters, it may be advantageous to position the withdrawal strainers close to the bottom. Also, in connection with heavily overloaded digesters that can not be provided with a sufficient supply of wash liquor enabling a sufficient up-flow for counter-current cooking, the invention can be used by supplying a wash liquid at in the bottom and preferably also by means of a central pipe that displaces a liquid radially to a screen section.

Further, it should be understood that some advantages of the present invention are also achieved in a two zones digester, even if almost the same temperature is maintained in the concurrent and the counter-current cooking zones.

While the present invention has been described in accordance with preferred compositions and embodiments, it is to be understood that certain substitutions and alterations may be made thereto without departing from the spirit and scope of the following claims.

We claim:

1. A separator disposed in a digester having a digester wall, comprising:

a screw feeder having an inlet end and an outlet end for feeding a fiber material in an upward direction from the inlet end towards the outlet end of the screw feeder;

the digester having an inlet opening defined therein for receiving a suspension of the fiber material and a transport liquid, and the digester having an outlet opening defined therein;

a rotatable shaft in operative engagement with the screw feeder;

a drive unit secured to the rotatable shaft for rotating the rotatable shaft;

a cylindrical screen basket having a central space defined therein for enclosing the screw feeder;

the cylindrical screen basket having a liquid collecting space defined therein, the liquid collecting space being in fluid communication with the central space of the cylindrical screen basket; and a distribution means for supplying a supply liquid to the fiber material, the distribution means being disposed circumjacent to the screen basket and adjacent to the outlet end of the screw feeder.

2. The separator according to claim 1 wherein the separator has a first liquid inlet aperture defined therein, the liquid inlet aperture is disposed adjacent the outlet end of the screw feeder.

3. The separator according to claim 2 wherein the first liquid inlet aperture comprises an opening that opens up into the screen basket, the opening having a total area exceeding 400 $mm^2$.

4. The separator according to claim 3 wherein the opening comprises a number of symmetrically positioned circular holes.

5. The separator according to claim 3 wherein the opening comprises a number of symmetrically positioned slots.

6. The separator according to claim 2 wherein the first liquid inlet aperture comprises an opening that opens up into the screen basket, the opening having a total area exceeding 600 $mm^2$.

7. The separator according to claim 2 wherein the first liquid inlet aperture comprises an opening that opens up into the screen basket, the opening having a total area exceeding 500 $mm^2$.

8. The separator according to claim 2 wherein the digester has a second liquid supply aperture defined therein, the second liquid supply aperture is disposed between the liquid collection space and the first liquid supply aperture.

9. The separator according to claim 1 wherein the inlet opening of the digester is positioned below the first liquid inlet aperture.

10. The separator according to claim 1 wherein the inlet opening is disposed below the liquid collecting space.

11. The separator according to claim 1 wherein the screw member has a rotatable helical blade section.

12. The separator according to claim 11 wherein the helical blade section is rotatable to move the fiber material through the screw feeder.

13. The separator according to claim 1 wherein the screen basket permits the transport liquid to penetrate therethrough and prevents the fiber material from penetrating therethrough.

14. A separator disposed in a digester having a digester wall, comprising:

a screw feeder having an inlet end and an outlet end for feeding a fiber material in an upward direction from the inlet end towards the outlet end of the screw feeder;

the digester having an inlet opening defined therein for receiving a suspension of the fiber material and a transport liquid, and the digester having an outlet opening defined therein;

a cylindrical screen basket having a central space defined therein for enclosing the screw feeder;

the digester having a liquid inlet aperture defined therein adjacent the outlet end of the screw feeder, the liquid inlet aperture being disposed above the inlet opening, the liquid inlet aperture having a total area exceeding 400 $mm^2$;

the cylindrical screen basket having a liquid collecting space defined therein, the liquid collecting space being in fluid communication with the central space of the cylindrical screen basket; and a distribution means for supplying a supply liquid to the fiber material, the distribution means being disposed circumjacent to the screen basket and adjacent to the outlet end of the screw feeder.

15. The separator according to claim 14 wherein the digester has a second liquid supply aperture defined therein, the second liquid supply aperture is disposed between the liquid collection space and the first liquid supply aperture.

16. A steam/liquid phase digester having a digester with a top portion, comprising:

the digester having an inlet opening and an outlet opening defined therein, the digester having a digester wall;

a separator comprising:

a screw feeder having an inlet end and an outlet end for feeding a fiber material in an upward direction from the inlet end towards the outlet end of the screw feeder;

a rotatable shaft in operative engagement with the screw feeder;

a drive unit secured to the rotatable shaft for rotating the rotatable shaft;

a cylindrical screen basket enclosing the screw feeder;

the cylindrical screen basket having a liquid collection space defined therein, the liquid collecting space being in fluid communication with the outlet opening of the digester;

the digester having a liquid inlet opening defined therein adjacent the outlet end of the screw feeder for receiving a cooking liquor;

a first screen girdle section disposed below the top portion of the digester; and a distribution means for supplying a supply liquid to the fiber material, the distribution means being disposed circumjacent to the screen basket and adjacent to the outlet end of the screw feeder.

17. The steam/liquid phase digester system according to claim 16 wherein the steam/liquid phase digester further comprises a connecting line that extends between an inlet portion of an impregnation zone and the first screen girdle section of the digester for supplying the impregnation zone with a spent liquor that is withdrawn from the first screen girdle section.

18. The steam/liquid phase digester system according to claim 17 wherein the cylindrical screen basket has a liquid collecting space defined therein and the steam/liquid phase digester comprises a return line connected to a top portion of the digester for conveying a transport liquid from the liquid collecting space to an outlet portion of the impregnation zone.

19. The steam/liquid phase digester system according to claim 18 wherein the steam/liquid phase digester further comprises a second screen girdle section disposed below the first screen girdle section, a second conduit is in fluid communication with the second screen girdle section to withdraw spent liquor from the second screen girdle section, a cooking liquor conduit has one end attached to a top portion of the digester to supply the top portion with a cooking liquor, a branch conduit has one end attached to the cooking liquor conduit and an opposite end attached to the second conduit to conduct a portion of the cooking liquor in the cooking liquor conduit to the second conduit.

20. The steam/liquid phase digester system according to claim 19 wherein the steam/liquid phase digester has a middle screen girdle section disposed between a bottom screen girdle section and the first screen girdle section, a middle conduit is in fluid communication with the middle screen girdle section to conduct spent liquor from the middle screen girdle section to a top portion of the digester.

21. The steam/liquid phase digester system according to claim 20 wherein the steam/liquid phase digester system is a single vessel steam/liquid phase digesting system and the cooking liquor conduit is in fluid communication with a recirculation line disposed adjacent the first screen girdle section, the recirculation line conducts the spent liquor withdrawn from the first screen girdle section and the cooking liquor from the cooking liquor conduit back to an impregnation zone of the digester.

22. The steam/liquid phase digester system according to claim 21 wherein the recirculation line has a heat exchanger that is in operative engagement with the recirculation line and a high pressure steam line.

23. The steam/liquid phase digester system according to claim 18 wherein the impregnation zone is disposed in an impregnation vessel and a transport conduit is operatively attached to a bottom of the impregnation vessel to conduct the fiber material and the transport liquid to a liquid exchanger that exchanges a liquid in the transport conduit before the fiber material and the transport liquid are conducted to a top portion of the steam/liquid phase digester.

24. The steam/liquid phase digester system according to claim 23 wherein the first screen girdle section is in fluid communication with a conduit that conducts the spent liquor withdrawn from the first screen girdle section to both the impregnation vessel and to a first flash tank, the first screen girdle section is adjacent a bottom of the digester.

25. The steam/liquid phase digester system according to claim 24 wherein the steam/liquid phase digester further comprises a first flash tank conduit that is operatively attached to the first flash tank to conduct spent liquor back to a high pressure feeder.

26. The steam/liquid phase digester system according to claim 23 wherein the impregnation vessel has a screen girdle section disposed adjacent the outlet portion of the impregnation vessel, a conduit is in fluid communication with the screen girdle section of the impregnation vessel to conduct spent liquor away from the impregnation vessel into a second flash tank.

27. The steam/liquid phase digester system according to claim 18 wherein a recirculation line is operatively attached to the return line to recirculate a portion of the transport liquid back to the top portion of the digester.

28. The steam/liquid phase digester system according to claim 17 wherein a conduit extends between the cooking liquor conduit and the return line to conduct the cooking liquor to the return line.

29. The steam/liquid phase digester system according to claim 16 wherein the digester further comprises a recirculation loop that is in fluid communication with the first screen girdle section disposed in the digester for recirculating the cooking liquor back to the top portion of the digester.

30. The steam/liquid phase digester according to claim 29 wherein the steam/liquid phase digester further comprises a second screen girdle section that is disposed below the first screen girdle section and a second conduit extends between the second screen girdle section back to a point above the first screen girdle section for supplying a spent liquor that is withdrawn from the second screen girdle section to a central pipe that extends from the first screen girdle section to a second screen girdle section.

31. The steam/liquid phase digester according to claim 30 wherein the steam/liquid phase digester comprises a third screen girdle section that is disposed below the second screen girdle section and a third conduit is attached to the third screen girdle section to conduct a spent liquor withdrawn from the third screen girdle section back to the recirculation loop.

32. The steam/liquid phase digester according to claim 31 wherein the steam/liquid phase digester further comprises a cooking liquor conduit that has one end attached to the second conduit to conduct a portion of the cooking liquor in the cooking liquor conduit to the second conduit.

33. The steam/liquid phase digester system according to claim 16 wherein the steam/liquid phase digester system is a single vessel digester system.

34. The steam/liquid phase digester system according to claim 33 wherein the steam/liquid phase digester system has an impregnation zone disposed above a concurrent cooking zone inside the digester, a second screen girdle section is disposed below the first screen girdle section to conduct spent liquor via a second conduit back to the impregnation zone of the digester.

35. The steam/liquid phase digester system according to claim 16 wherein the steam/liquid phase digester has a bottom screen girdle section that is adjacent a bottom portion of the digester, a screen conduit is in fluid communication with the bottom screen girdle section to withdraw spent liquor from the bottom screen girdle section, a cooking liquor conduit is in fluid communication with the screen conduit for conducting cooking liquor to the screen conduit.

36. The steam/liquid phase digester system according to claim 16 wherein a first conduit extends between the first screen girdle section and a point in the impregnation zone to conduct spent liquor back to the impregnation zone, a cooking liquor conduit is operatively attached to the first conduit to conduct white liquor to the first conduit.

37. A steam/liquid phase digester system, comprising:

an impregnation vessel having a separator disposed therein, the separator comprising:

a screw feeder having an inlet end and an outlet end for feeding a fiber material in an upward direction from the inlet end towards the outlet end of the screw feeder;

the impregnation vessel having an inlet opening defined therein for receiving a suspension of the fiber material and a transport liquid, and the impregnation vessel having an outlet opening defined therein;

a rotatable shaft in operative engagement with the screw feeder;

a drive unit secured to the rotatable shaft for rotating the rotatable shaft;

a cylindrical screen basket enclosing the screw feeder;

the cylindrical screen basket having a liquid collecting space defined therein, the liquid collecting space being in fluid communication with the outlet opening of the impregnation vessel; and a distribution means for supplying a supply liquid to the fiber material, the distribution means being disposed circumjacent to the screen basket and adjacent to the outlet end of the screw feeder.

38. The steam/liquid phase digester system according to claim 37 wherein the separator has a first diameter and the impregnation vessel has a mid-portion having a second diameter, the second diameter being at least twice as great as the first diameter.

39. The steam/liquid phase digester system according to claim 37 wherein the inlet opening comprises an annular distribution ring for supplying a liquid to the fiber material.

40. The steam/liquid phase digester system according to claim 37 wherein the screw member has a rotatable helical blade section.

41. The steam/liquid phase digester system according to claim 40 wherein the helical blade section is rotatable to move the fiber material through the screw feeder.

42. The steam/liquid phase digester system according to claim 37 wherein the screen basket permits the transport liquid to penetrate therethrough and prevents the fiber material from penetrating therethrough.

* * * * *